US009097254B2

(12) United States Patent
Lee et al.

(10) Patent No.: US 9,097,254 B2
(45) Date of Patent: Aug. 4, 2015

(54) COMPRESSOR

(75) Inventors: Kangwook Lee, Changwon-si (KR); Jin-Ung Shin, Changwon-si (KR); Yongchol Kwon, Changwon-si (KR); Geun-Hyoung Lee, Busan (KR)

(73) Assignee: LG ELECTRONICS INC., Seoul (KR)

( * ) Notice: Subject to any disclaimer, the term of this patent is extended or adjusted under 35 U.S.C. 154(b) by 320 days.

(21) Appl. No.: 13/054,981

(22) PCT Filed: Nov. 28, 2008

(86) PCT No.: PCT/KR2008/007015

§ 371 (c)(1),
(2), (4) Date: Jan. 20, 2011

(87) PCT Pub. No.: WO2010/010998

PCT Pub. Date: Jan. 28, 2010

(65) Prior Publication Data

US 2011/0123366 A1 May 26, 2011

(30) Foreign Application Priority Data

| | | |
|---|---|---|
| Jul. 22, 2008 | (KR) | 10-2008-0071381 |
| Nov. 13, 2008 | (KR) | 10-2008-0112737 |
| Nov. 13, 2008 | (KR) | 10-2008-0112746 |
| Nov. 13, 2008 | (KR) | 10-2008-0112750 |
| Nov. 13, 2008 | (KR) | 10-2008-0112761 |

(51) Int. Cl.
*F04C 18/32* (2006.01)
*F04C 23/00* (2006.01)
(Continued)

(52) U.S. Cl.
CPC ..... *F04C 18/322* (2013.01); *F04C 18/32* (2013.01); *F04C 23/008* (2013.01); *F04C 29/0085* (2013.01); *F04C 15/0007* (2013.01); *F04C 2240/603* (2013.01)

(58) Field of Classification Search
CPC ..... F04C 18/322; F04C 18/32; F04C 23/008; F04C 2240/603; F04C 29/0085; F04C 15/0007
USPC ..... 417/356, 357, 410.3, 902; 418/91, 94, 418/98, 102, 228–229, 216–218, 63; 184/6.61
See application file for complete search history.

(56) References Cited

U.S. PATENT DOCUMENTS

| | | | |
|---|---|---|---|
| 1,526,449 | A | 2/1925 | Wishart |
| 1,947,016 | A | 2/1934 | Mallory |

(Continued)

FOREIGN PATENT DOCUMENTS

| | | |
|---|---|---|
| CN | 1963224 | 5/2007 |
| EP | 1 798 372 A1 | 6/2007 |

(Continued)

OTHER PUBLICATIONS

International Search Report issued in PCT Application No. PCT/KR2008/007014 dated Feb. 10, 2010.

(Continued)

*Primary Examiner* — Devon Kramer
*Assistant Examiner* — Joseph Herrmann
(74) *Attorney, Agent, or Firm* — Ked & Associates, LLP

(57) ABSTRACT

A compressor is provided that eliminates sliding contacts between a cylinder and a roller to minimize mixing of lubricating oil into a refrigerant. The compressor includes a hermetic container that stores the lubricating oil at a lower portion thereof; a stator mounted within the hermetic container; a cylinder type rotor that rotates within the stator by a rotating electromagnetic field of the stator and defines a compression chamber therein; a roller that rotates and compresses the refrigerant by a rotational force transferred from the rotor; a rotational shaft integrally formed with the roller; a vane that divides the compression chamber into suction and compression regions and transfers the rotational force to the roller; and oil feed passages provided in the rotational shaft and the roller to feed the lubricating oil to areas where two or more members are slidingly engaged with one another within the compression chamber.

21 Claims, 16 Drawing Sheets

(51) Int. Cl.
*F04C 29/00* (2006.01)
*F04C 15/00* (2006.01)

(56) References Cited

U.S. PATENT DOCUMENTS

| | | | | | |
|---|---|---|---|---|---|
| 1,998,604 | A | | 4/1935 | Belden | |
| 2,246,273 | A | * | 6/1941 | Davidson | 418/77 |
| 2,246,275 | A | * | 6/1941 | Davidson | 417/356 |
| 2,246,276 | A | * | 6/1941 | Davidson | 417/372 |
| 2,309,577 | A | | 1/1943 | Ward | |
| 2,324,434 | A | | 7/1943 | Shore | |
| 2,331,878 | A | | 10/1943 | Wentworth | |
| 2,420,124 | A | * | 5/1947 | Coulson | 417/356 |
| 2,440,593 | A | * | 4/1948 | Miller | 418/88 |
| 2,898,032 | A | | 8/1959 | Bernhard | |
| 3,070,078 | A | | 12/1962 | Horst | |
| 3,499,600 | A | * | 3/1970 | McGregor | 418/88 |
| 3,723,024 | A | | 3/1973 | Sawai et al. | |
| 4,478,559 | A | | 10/1984 | Andrione et al. | |
| 4,629,403 | A | | 12/1986 | Wood | |
| 4,710,111 | A | * | 12/1987 | Kubo | 418/63 |
| 4,714,416 | A | | 12/1987 | Sano | |
| 4,844,703 | A | | 7/1989 | Watanabe et al. | |
| 5,522,235 | A | | 6/1996 | Matsuoka et al. | |
| 5,547,344 | A | | 8/1996 | Sugiyama et al. | |
| 5,564,916 | A | | 10/1996 | Yamamoto et al. | |
| 5,577,903 | A | * | 11/1996 | Yamamoto | 418/66 |
| 5,580,231 | A | * | 12/1996 | Yasui | 418/66 |
| 5,616,019 | A | | 4/1997 | Hattori et al. | |
| 6,077,058 | A | | 6/2000 | Saitou et al. | |
| 6,213,732 | B1 | | 4/2001 | Fujio | |
| 6,478,558 | B2 | | 11/2002 | Yamanaka et al. | |
| 6,484,846 | B1 | * | 11/2002 | Parker | 184/6.16 |
| 6,491,063 | B1 | | 12/2002 | Benatav | |
| 6,749,405 | B2 | | 6/2004 | Bassine | |
| 6,881,041 | B2 | | 4/2005 | Lee | |
| 6,929,455 | B2 | | 8/2005 | Dreiman et al. | |
| 7,029,252 | B2 | | 4/2006 | Masuda et al. | |
| 7,104,764 | B2 | | 9/2006 | Lee et al. | |
| 7,217,110 | B2 | * | 5/2007 | Dreiman | 418/173 |
| 7,293,966 | B2 | | 11/2007 | Cho et al. | |
| 7,344,367 | B2 | | 3/2008 | Manole | |
| 7,361,004 | B2 | | 4/2008 | Hwang et al. | |
| 7,556,485 | B2 | | 7/2009 | Kanayama et al. | |
| 7,704,060 | B2 | | 4/2010 | Morimoto et al. | |
| 2004/0071570 | A1 | | 4/2004 | Dreiman et al. | |
| 2005/0008519 | A1 | | 1/2005 | Masuda et al. | |
| 2005/0031465 | A1 | * | 2/2005 | Dreiman et al. | 417/356 |
| 2005/0201884 | A1 | | 9/2005 | Dreiman | 418/173 |
| 2006/0159570 | A1 | | 7/2006 | Manole | |
| 2007/0059189 | A1 | | 3/2007 | Nakano et al. | |
| 2007/0122284 | A1 | | 5/2007 | Bae et al. | |
| 2012/0171065 | A1 | | 7/2012 | Lee | |

FOREIGN PATENT DOCUMENTS

| | | | |
|---|---|---|---|
| FR | 345995 | A | 12/1904 |
| FR | 1367234 | A | 7/1964 |
| GB | 478146 | | 1/1938 |
| JP | 57-186086 | A | 11/1982 |
| JP | 60-187783 | A | 9/1985 |
| JP | 60-206995 | A | 10/1985 |
| JP | 61-187591 | A | 8/1986 |
| JP | 01-232191 | A | 9/1989 |
| JP | 2008-069643 | | 3/2008 |
| KR | 20-0252922 | | 11/2001 |
| KR | 10-2004-0003346 | | 1/2004 |
| KR | 10-2005-0012009 | | 1/2005 |
| KR | 10-2007-0073314 | | 7/2007 |
| WO | WO 2007/074637 | | 7/2007 |
| WO | WO 2008/004983 | | 1/2008 |

OTHER PUBLICATIONS

International Search Report issued in PCT Application No. PCT/KR2008/007006 dated Feb. 10, 2010.
International Search Report issued in PCT Application No. PCT/KR2008/007007 dated Feb. 16, 2010.
International Search Report issued in PCT Application No. PCT/KR2008/007008 dated Feb. 16, 2010.
International Search Report issued in PCT Application No. PCT/KR2008/007016 dated Feb. 16, 2010.
International Search Report issued in PCT Application No. PCT/KR2008/007015 dated Feb. 10, 2010.
European Search Report dated Feb. 1, 2012 issued in Application No. 08 87 6616.
European Search Report dated Feb. 1, 2012 issued in Application No. 08 87 6617.
European Search Report dated Feb. 1, 2012 issued in Application No. 08 87 6619.
U.S. Office Action issued in U.S. Appl. No. 13/055,026 dated Mar. 25, 2013.
U.S. Notice of Allowance issued in U.S. Appl. No. 13/055,026 dated Sep. 12, 2013.
U.S. Office Action issued in U.S. Appl. No. 13/055,020 dated Sep. 23, 2013.
U.S. Office Action issued in U.S. Appl. No. 13/055,040 dated Oct. 10, 2013.
U.S. Office Action issued in U.S. Appl. No. 13/054,963 dated Oct. 10, 2013.
U.S. Office Action issued in U.S. Appl. No. 13/055,020 dated Mar. 10, 2014.
U.S. Office Action issued in U.S. Appl. No. 13/054,970 dated Jan. 31, 2014.
Korean Office Action dated Jul. 29, 2014. (051523816).
Korean Office Action dated Jul. 29, 2014. (051556722).
Korean Office Action dated Jun. 2, 2014. (0112746).
Korean Office Action dated Jun. 2, 2014. (0112749).
Korean Office Action dated Jun. 24, 2014. (0112740).
U.S. Office Action issued in U.S. Appl. No. 13/055,020 dated Jun. 25, 2014.
U.S. Notice of Allowance issued in U.S. Appl. No. 13/054,963 dated Jun. 30, 2014.
U.S. Office Action issued in U.S. Appl. No. 13/054,981 dated Nov. 5, 2014.
U.S. Office Action issued in U.S. Appl. No. 13/055,020 dated Nov. 24, 2014.

* cited by examiner

COMPRESSOR

TECHNICAL FIELD

The present invention relates in general to a compressor, and more particularly, to a compressor which eliminates sliding contacts between a cylinder and a roller to minimize the mixing of lubricating oil into refrigerant, and is structured to be able to evenly distributing lubricating oil over sliding contact portions of a compressor actuator by pumping the oil from the inside on an axis of rotation.

In addition, the present invention relates to a compressor having a structure to accommodate a refrigerant passage separately from an oil feed passage such that the mixing of oil into refrigerant is minimized and the operational reliability is enhanced.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in electric home appliances such as a refrigerator and an air conditioner, or in the whole industry.

The compressors are roughly classified into a reciprocating compressor wherein a compression chamber to/from which an operation gas is sucked and discharged is defined between a piston and a cylinder and refrigerant is compressed as the piston linearly reciprocates inside the cylinder, a rotary compressor which compresses an operation gas in a compression chamber defined between an eccentrically-rotated roller and a cylinder, and a scroll compressor wherein a compression chamber to/from which an operation gas is sucked and discharged is defined between an orbiting scroll and a fixed scroll and refrigerant is compressed as the orbiting scroll rotates along the fixed scroll.

Although the reciprocating compressor is excellent in mechanical efficiency, its reciprocating motion causes serious vibrations and noise problems. Because of this problem, the rotary compressor has been developed as it has a compact size and demonstrates excellent vibration properties.

The rotary compressor is configured in a manner that a motor and a compression mechanism part are mounted on a drive shaft in a hermetic container, a roller fitted around an eccentric portion of the drive shaft is positioned inside a cylinder that has a cylinder shape compression chamber therein, and at least one vane is extended between the roller and the compression chamber to divide the compression chamber into a suction region and a compression region, with the roller being eccentrically positioned in the compression chamber. In general, vanes are supported by springs in a recess of the cylinder to pressurize surface of the roller, and the vane(s) as noted above divide(s) the compression chamber into a suction region and a compression region. In general, vanes are supported by springs in a recess of the cylinder to pressurize surface of the roller, and the vane(s), as noted above, divide(s) the compression chamber into a suction region and a compression region. The suction region expands gradually with the rotation of the drive shaft to suck refrigerant or a working fluid into it, while the compression region shrinks gradually at the same time to compress refrigerant or a working fluid in it.

In such a conventional rotary compressor, the eccentric portion of the drive shaft continuously makes a sliding contact, during its rotation, with an interior surface of a stationary cylinder where the roller is secured and with the tip of the vane where the roller is also secured. A high relative velocity is created between constituent elements making a sliding contact with each other, and this generates frictional loss, eventually leading to degradation of compressor efficiency. Also, there is still a possibility of a refrigerant leak at the contact surface between the vane and the roller, thereby causing degradation of mechanical reliability.

Unlike the conventional rotary compressors subject to stationary cylinders, U.S. Pat. No. 7,344,367 discloses a rotary compressor having a compression chamber positioned between a rotor and a roller rotatably mounted on a stationary shaft. In this patent, the stationary shaft extends longitudinally inwardly within a housing and a motor includes a stator and a rotor, with the rotor being rotatably mounted on the stationary shaft within the housing the roller being rotatably mounted on an eccentric portion that is integrally formed with the stationary shaft. Further, a vane is interposed between the rotor and the roller to let the roller rotate along with the rotation of the roller, such that a working fluid can be compressed within the compression chamber. However, even in this patent, the stationary shaft still makes a sliding contact with an interior surface of the roller so a high relative velocity is created between them and the patent still shares the problems found in the conventional rotary compressor.

Meanwhile, WO2008/004983 discloses another type of rotary compressors, comprising: a cylinder, a rotor mounted in the cylinder to rotate eccentrically with respect to the cylinder, and a vane positioned within a slot which is arranged at the rotor, the vane sliding against the rotor, wherein the vane is connected to the cylinder to transfer a force to the cylinder rotating along with the rotation of the rotor, and wherein a working fluid is compressed within a compression chamber defined between the cylinder and the rotor. However, these rotary compressors require a separate electric motor for driving the rotor because the rotor rotates by a drive force transferred through the drive shaft. That is, when it comes to the rotary compressor in accordance with the disclosure, a separate electric motor is stacked up in the height direction about the compression mechanism part consisting of the rotor, the cylinder and the vane, so the total height of the compressor inevitably increases, thereby making difficult to achieve compact design.

Moreover, rotary compressors require lubrication to reduce frictional force and frictional heat between members that make a sliding contact while rotating. In a conventional compressor, the roller and the cylinder are typical members making a sliding contact so an interior of the compression chamber had to be lubricated, and this made it unavoidable the mixing of refrigerant and lubricating oil. On account of this, an accumulator had to be installed additionally to separate the refrigerant from the lubricating oil, which required extra large compressors and became the leading cause of manufacturing cost.

Besides, in case the electromotive mechanism and the compression mechanism are connected with a drive shaft and laminated in the height direction, an oil pump and an oil feed passage had to be provided additionally. Also, with the approach of pumping up the lubricating oil stored at the bottom of the interior of the housing and then scattering the oil upward to feed it to the compression mechanism, the lubricating oil could not be distributed evenly over the sliding contact portions.

DISCLOSURE OF INVENTION

Technical Problem

The present invention is conceived to solve the aforementioned problems in the prior art. An object of the present invention is to provide a compressor which eliminates sliding contacts between a cylinder and a roller thereby minimizing the mixing of lubricating oil into refrigerant, and is structured a structure to be able to evenly distributing lubricating oil over sliding contact portions.

Another object of the present invention is to provide a compressor having a structure of high oil recovery and enhanced operational reliability by minimizing the mixing of oil into refrigerant.

Technical Solution

An aspect of the present invention provides a compressor, comprising: a hermetic container storing oil at a lower portion; a stator mounted within the hermetic container; a cylinder type rotor rotating within the stator by a rotating electromagnetic field from the stator, with the rotor defining a compression chamber inside; a roller rotating within the compression chamber of the cylinder type rotor by a rotational force transferred from the rotor, with the roller compressing refrigerant during rotation; an axis of rotation integrally formed with the roller and extending in an axial direction; a vane dividing the compression chamber into a suction region where refrigerant is sucked in and a compression region where the refrigerant is compressed/discharged from, with the vane transferring the rotational force from the cylinder type rotor to the roller; and oil feed passages provided to the axis of rotation and the roller, with the oil feed passage feeding oil that is pumped along the motion of the axis of rotation to an area where two or more members are slid onto within the compression chamber.

The compressor of in accordance with the first embodiment of the present invention further comprises: first and second covers joined to the cylinder type rotor in the axial direction, with the covers defining the compression chamber therebetween and receiving the axis of rotation therethrough; and first and second bearings joined to the first and second covers for rotatably supporting the axis of rotation, the roller, and the first and second covers onto the hermetic container.

In the compressor of in accordance with the first embodiment of the present invention, the oil feed passage comprises an oil feeder formed within the axis of rotation that is protruded from one side of the roller in the axis direction, and a first oil feed hole radially passing through one portion of the axis of rotation that is contiguous with the roller to be in communication with the oil feeder.

In the compressor of in accordance with the first embodiment of the present invention, the oil feed passage further comprises first oil storage cavities formed in the axis of rotation having the first oil feed hole and in one axial side of the roller, with the roller being connected to the axis of rotation, so as to temporarily collect oil supplied through the first oil feed hole.

In the compressor of in accordance with the first embodiment of the present invention, the first oil storage cavities are formed to lubricate a bearing in contact with an outer circumferential surface of the axis of rotation and with one axial side of the second rotating member.

In the compressor of in accordance with the first embodiment of the present invention, the oil feed passage further comprises a second oil feed hole axially passing through the second rotating member to be in communication with the first oil storage cavities, and second oil storage cavities formed in the other axial side of the second rotating member having the second oil feed hole and in the axis of rotation connected thereto so as to temporarily collect oil supplied through the second feed hole.

In the compressor of in accordance with the first embodiment of the present invention, the second oil storage cavities are formed to lubricate a bearing in contact with the axis of rotation and the other axial side of the roller.

In the compressor of in accordance with the first embodiment of the present invention, the oil feed passage further comprises oil feed cavities provided to the roller and the vane so as to communicate with at least one of the first and second oil storage cavities.

In the compressor of in accordance with the first embodiment of the present invention, the oil feed passage is mounted with an oil feed member for pumping oil up to an oil feeder, with the oil feed member being twisted in a spiral shape.

In the compressor of in accordance with the first embodiment of the present invention, the oil feeder feeds oil through the oil feed passage by a capillary phenomenon.

In the compressor of in accordance with the first embodiment of the present invention, the oil feeder has a groove in an inner circumferential thereof, and an oil feed member is press fitted therein except for the groove.

In the compressor of in accordance with the first embodiment of the present invention, the oil feed member having a groove in an outer circumferential surface is press fitted into the oil feeder.

A compressor in accordance with the second embodiment of the present invention further comprises a shaft cover and a main cover joined to the cylinder type roller and the roller in the axial direction for defining a compression chamber therebetween, with the shaft cover covering the axis of rotation, with the main cover receiving the axis of rotation; a mechanical seal axially joined to the shaft cover and rotatably supporting the shaft cover onto the hermetic container; and a bearing axially joined to the main cover and rotatably supporting the main cover, the axis of rotation and the roller onto the hermetic container.

In the compressor of in accordance with the second embodiment of the present invention, the oil feed passage comprises an oil feeder formed within the axis of rotation in the axis direction, and a first oil feed hole radially passing through one portion of the axis of rotation that is contiguous with the roller to be in communication with the oil feeder.

In the compressor of in accordance with the second embodiment of the present invention, the oil feed passage further comprises first oil storage cavities formed in the axis of rotation having the first oil feed hole and in one axial side of the roller, with the roller being connected to the axis of rotation, so as to temporarily collect oil supplied through the first oil feed hole.

In the compressor of in accordance with the second embodiment of the present invention, the first oil storage cavities are formed to lubricate a bearing in contact with an outer circumferential surface of the axis of rotation and with one axial side of the second rotating member.

In the compressor of in accordance with the second embodiment of the present invention, the oil feed passage further comprises a second oil feed hole axially passing through the second rotating member to be in communication with the first oil storage cavities, and second oil storage cavities formed in the other axial side of the roller having the second oil feed hole so as to temporarily collect oil supplied through the second feed hole.

In the compressor of in accordance with the second embodiment of the present invention, the second oil storage cavities are formed to lubricate a bearing in contact with the axis of rotation and with the other axial side of the roller.

In the compressor of in accordance with the second embodiment of the present invention, the shaft cover has cavities for storing oil which are formed on an opposite side of the second oil storage cavities.

In the compressor of in accordance with the second embodiment of the present invention, the oil feed passage further comprises oil feed cavities provided to the roller and the vane so as to communicate with at least one of the first and second oil storage cavities.

In the compressor of in accordance with the second embodiment of the present invention, the oil feed passage is mounted with an oil feed member for pumping oil up to an oil feeder, with the oil feed member being twisted in a spiral shape.

In the compressor of in accordance with the second embodiment of the present invention, the oil feeder feeds oil through the oil feed passage by a capillary phenomenon.

In the compressor of in accordance with the second embodiment of the present invention, the oil feeder has a groove in an inner circumferential thereof, and an oil feed member is press fitted therein except for the groove.

In the compressor of in accordance with the second embodiment of the present invention, the oil feed member having a groove in an outer circumferential surface is press fitted into the oil feeder.

The compressor of the present invention comprises a refrigerant suction passage for sucking refrigerant into the compression chamber through the axis of rotation and the roller, with the refrigerant suction passage formed separately from an oil feed passage.

Advantageous Effects

The compressor having the above configuration in accordance with the present invention arranges the refrigerant passage separately from the oil passage, so it can prevent the mixing of refrigerant and oil and further reduce a much refrigerant and oil leak, thereby guaranteeing an enhanced operational reliability. Moreover, since the roller and the cylinder rotate together with the cover, a sliding contact is noticeably reduced so there is no need to extend the oil feed passage into the interior of the cylinder. In result, nearly none of the oil is mixed with the refrigerant, and the operational reliability as well as the endurance of drive members can be maximized.

The operational reliability of the compressor is also enhanced by providing a compressor with an efficient lubrication structure to evenly distribute lubricating oil over contact portions.

MODE FOR THE INVENTION

Hereinafter, preferred embodiments of the present invention will be described in detail with reference to the accompanying drawings.

Figure 1:
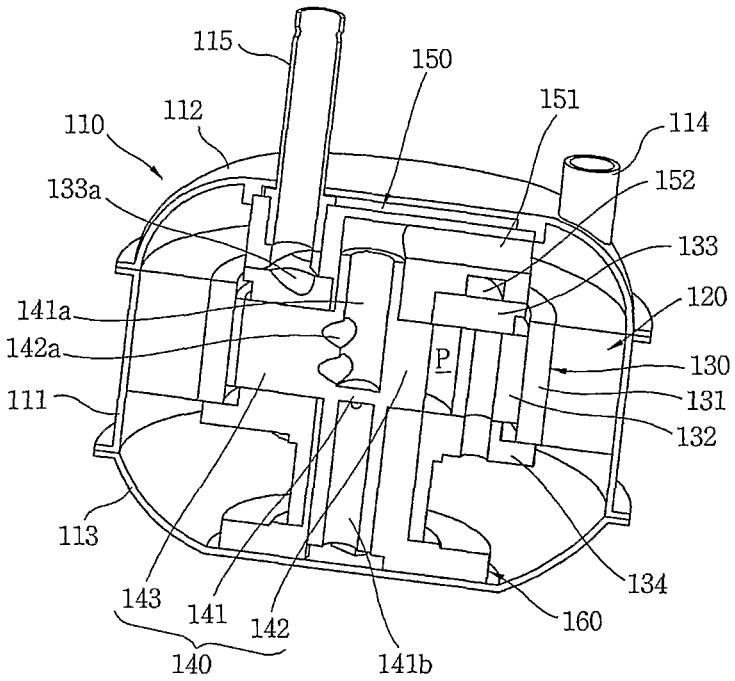
FIG. 1 is a transverse cross-sectional view showing a compressor in accordance with a first embodiment of the present invention.
Figure 2:
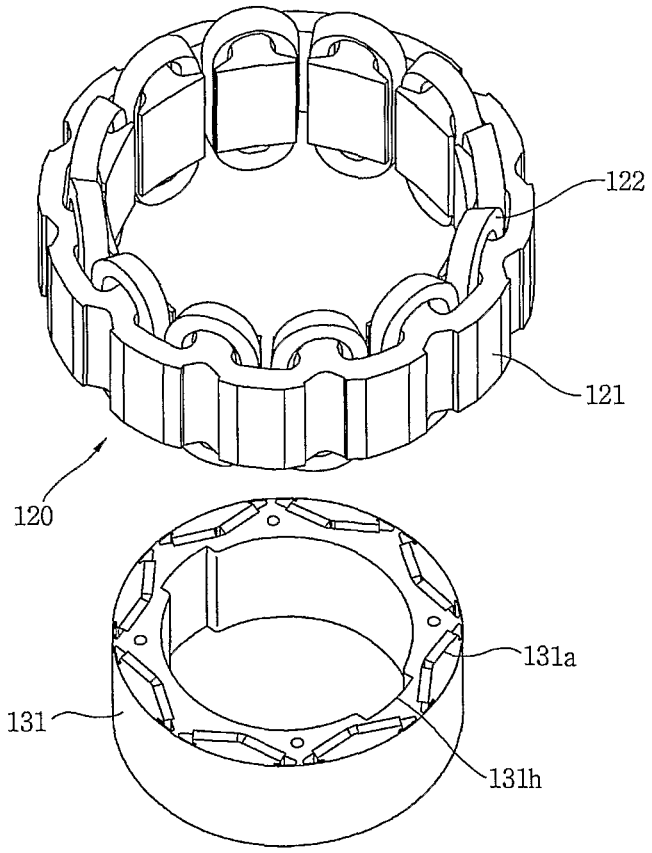
FIG. 2 is an exploded perspective view showing one example of an electromotive part of the compressor in accordance with the first embodiment of the present invention.
Figure 3:
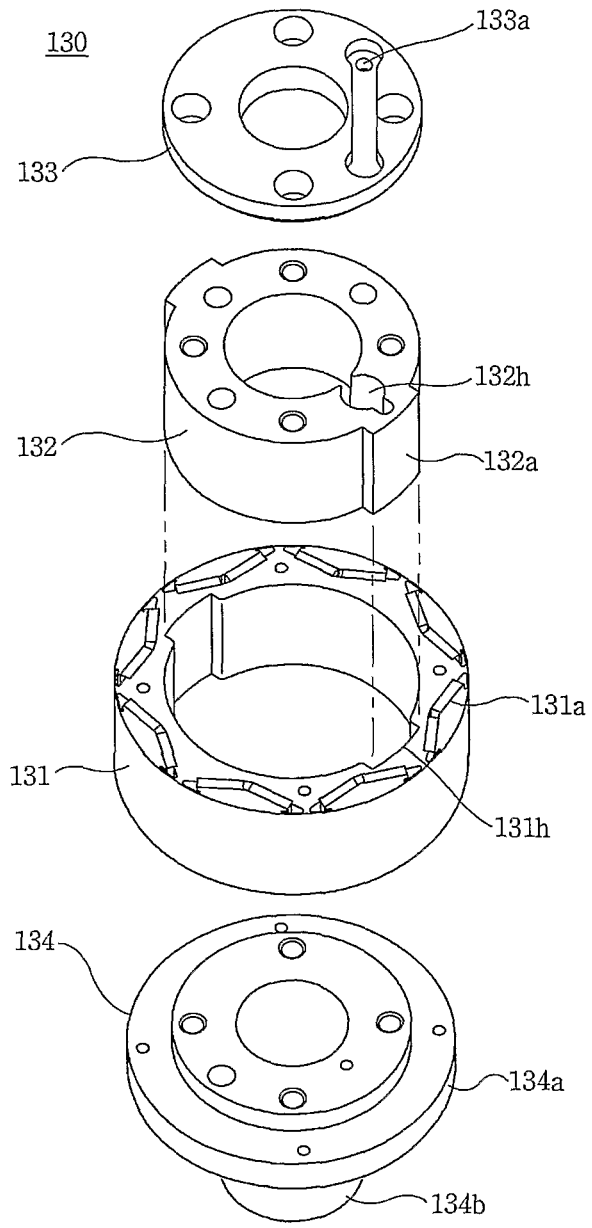
FIGS. 3 and 4 each illustrate an exploded perspective view showing one example of the compression mechanism part of the compressor in accordance with the first embodiment of the present invention.
Figure 4:
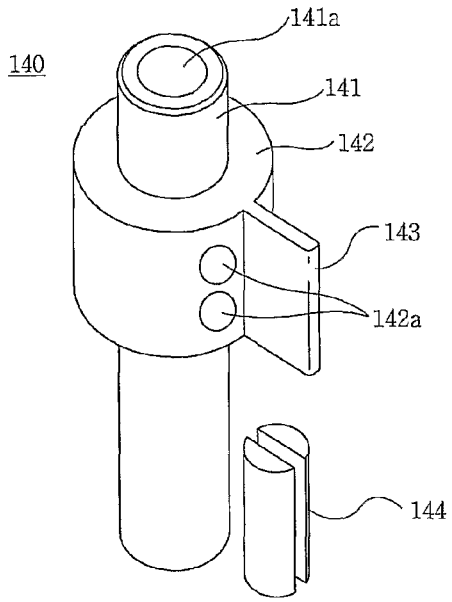

FIG. 1 is a transverse cross-sectional view showing a compressor in accordance with the present invention, FIG. 2 is an exploded perspective view showing one example of an electric motor of the compressor in accordance with the present invention, and FIGS. 3 and 4 each illustrate an exploded perspective view showing one example of a compression mechanism part of the compressor in accordance with the present invention.

As shown in FIG. 1, a compressor in accordance with a first embodiments of the present invention includes a hermetic container 110, a stator 120 installed within the hermetic container 110, a first rotating member 130 installed within the stator 120 and rotating by a rotating electromagnetic field from the stator 120, a second rotating member 140 rotating within the first rotating member 130 by a rotational force transferred from the first rotating member 130 for compressing refrigerant therebetween, and first and second bearings 150 and 160 supporting the first and second rotating members 130 and 140 to be able to rotate within the hermetic container 110. An electromotive mechanism part which provides power through an electrical reaction employs, for example, a BLDC motor including the stator 120 and the first rotating member 130, and a compression mechanism part which compresses refrigerant through a mechanical reaction includes the first and second rotating members 130 and 140, and the first and second bearings 150 and 160. Therefore, by installing the electromotive mechanism part and the compression mechanism part in a radial direction, the total height of the compressor can be reduced. Although the embodiments of the present invention describe a so-called inner rotor type having the compression mechanism part on the inside of the electromotive mechanism part as an example, any person of ordinary skill in the art would easily find out that the general ideal described above can also be applied conveniently to a so-called outer rotor type having the compression mechanism part on the outside of the electromotive mechanism part.

The hermetic container 110, as shown in FIG. 1, is composed of a cylinder-shaped body 111, and upper/lower shells 112 and 113 coupled to the top/bottom of the body 111 and stores oil at a suitable height to lubricate or smooth the first and second rotating members 130 and 140 (see FIG. 1). The upper shell 112 includes a suction tube 114 at a predetermined position for sucking refrigerant and a discharge tube 115 at another predetermined position for discharging refrigerant. Here, whether a compressor is a high-pressure type compressor or a low-pressure type compressor is determined depending on whether the interior of the hermetic container 110 is filled with compressed refrigerants or pre-compressed refrigerants, and the position of the suction tube 114 and discharge tube 115 should be determined based on that. In particular, this embodiment of the present invention introduces a low pressure compressor. To this end, the suction tube 114 is connected to the hermetic container 110 and the discharge tube 115 is connected to the compression mechanism part. Thus, when a low-pressure refrigerant is sucked in through the suction tube 114, it fills the interior of the hermetic container 110 and flows into the compression mechanism part. In the compression mechanism part, the low-pressure refrigerant is compressed to high pressure and then exits outside directly through the discharge tube 115. The stator 120, as shown in FIG. 2, is composed of a core 121, and a coil 122 primarily wound around the core 121. While a core used for a conventional BLDC motor has 9 slots along the circumference, the core 121 of a BLDC motor has 12 slots along the circumference because the stator in a preferred embodiment of the present invention has a relatively a large diameter. Considering that a coil winding number increases with an increasing number of core slots, in order to generate an electromagnetic force of the conventional stator 120, the core 121 may have a smaller height.

The first rotating member 130, as shown in FIG. 3, is composed of a rotor 131, a cylinder 132, a first cover 133 and a second cover 134. The rotor 131 has a cylindrical shape, with the rotor 131 rotating within the stator 120 (see FIG. 1) by a rotating electromagnetic field generated from the stator 120 (see FIG. 1), and inserted therethrough are plural permanent magnets 131*a* in an axial direction to generate a rotating magnetic field. Similar to the rotor 131, the cylinder 132 also takes the form of a cylinder to create a compression chamber P (see FIG. 1) inside. The rotor 131 and the cylinder 132 can be manufactured separately and joined together later. In one example, a pair of mount protrusions 132*a* is arranged at the outer circumferential surface of the cylinder 132, and grooves 131*h* having a corresponding shape to the mount protrusions 132*a* of the cylinder 132 are formed in the inner circumferential surface of the rotor 131 such that the outer circumferential surface of the cylinder 132 is engaged with the inner circumferential surface of the rotor 131. More preferably, the rotor 131 is integrally formed with the cylinder 132, with the permanent magnets 131*a* mounted in holes that are additionally formed in the axial direction.

The first cover 133 and the second cover 134 are coupled to the rotor 131 and/or the cylinder 132 in the axial direction, and the compression chamber P (see FIG. 1) is defined between the cylinder 132 and the first and second covers 133 and 134. The first cover 133 has a planar shape and is provided with a discharge port 133*a* through which a compressed refrigerant from the compression chamber P (see FIG. 1) exits and a discharge valve (not shown) mounted thereon. The second cover 134 is composed of a planar shape cover 134*a*, and a downwardly projecting hollow shaft 134*b* at the center. The shaft 134*b* is not absolutely required, but its role in receiving a load acting thereon increases a contact area with the second bearing 160 (see FIG. 1) and more stably supports the rotation of the second cover 134. Since the first and second covers 133 and 134 are bolt-fastened to the rotor 131 or the cylinder 132 in the axial direction, the rotor 131, the cylinder 132, and the first and second covers 133 and 134 rotate together as one unit.

Figure 5:
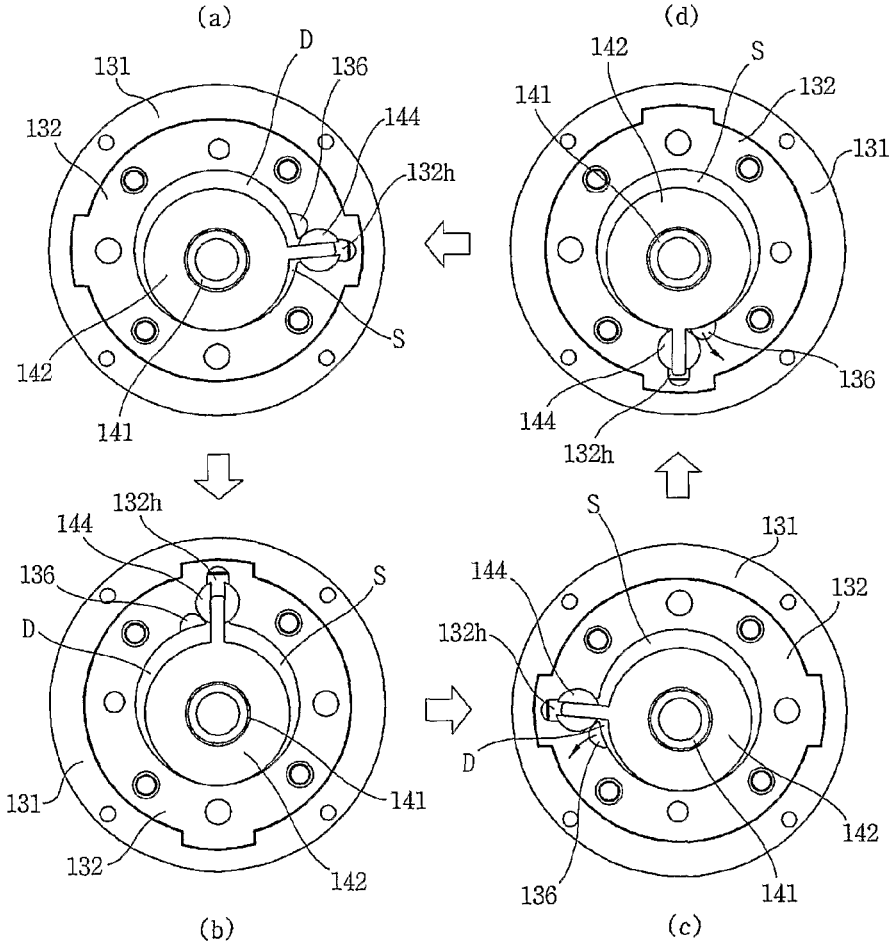
FIG. 5 is a plan view showing a vane mount structure adopted to a compressor in accordance with the present invention, and a running cycle of the compressor.

The second rotating member 140, as shown in FIG. 4, is composed of an axis of rotation 141, a roller 142, and a vane 143. The axis of rotation 141 is extended in the roller axis direction from both surfaces of the roller 142, with the axis being projected further from the bottom surface of the roller 142 than from the top surface of the roller 142 to provide stable support under any load. Preferably, the axis of rotation 141 is integrally formed with the roller 142, but even if they have been manufactured separately, they must join together to be able to rotate as one unit. As the axis of rotation 141 takes the form of a hollow shaft with a blocked center portion, it is better to arrange a suction passage 141*a* through which refrigerant is sucked in and a passage of an oil feeder 141*b* (see FIG. 1) separately from each other so as to minimize the mixing of oil and refrigerant. The oil feeder 141*b* (see FIG. 1) of the axis of rotation 141 is provided with a helical member to assist oil ascending by a rotational force, or a groove to assist oil ascending by a capillary action. The axis of rotation 141 and the roller 142 each have all kinds of oil feed holes (not shown) and oil storage cavities (not shown) for supplying oil from the oil feeder 141*b* (see FIG. 1) into between two or more members subject to sliding interactions. The roller 142 has suction passages 142*a* radially penetrating it for the communication of the suction passage 141*a* of the axis of rotation 141 with the compression chamber P (see FIG. 1), such that refrigerant is sucked into the compression chamber P (see FIG. 1) through the suction passage 141*a* of the axis of rotation 141 and the suction passage 142*a* of the roller 142. The vane 143 is formed on the outer circumference surface of the roller 142, with the vane 143 being disposed to extend radially and rotate at a preset angle while making a linear reciprocating motion, along bushes 144, within a vane mount slot 132*h* (see FIG. 5) of the first rotating member 130 (see FIG. 1). As shown in FIG. 5, a couple of bushes 144 limits the circumferential rotation of the vane 143 to below a preset angle and guides the vane 143 to make the linear reciprocating motion through a space defined between the couple of bushes 144 that are mounted within the vane mount slot 132*h* (see FIG. 5). Even though oil may be supplied to enable the vane 143 to attain successful lubrication while reciprocating linearly within the bushes 144, it is also possible to make the bushes 144 of natural-lubricating materials. For example, the bushes 144 can be manufactured in use of a suitable material sold under the trademark of Vespel SP-21. Vespel SP-21 is a polymer material which combines excellent wear resistance, heat resistance, natural lubricity, flame resistance, and electrical insulation.

FIG. 5 is a plan view showing a vane mount structure and a running cycle of the compression mechanism part in a compressor according to the present invention.

To explain the mount structure of the vane 143 with reference to FIG. 5, a vane mount slot 132*h* is formed axially and longitudinally in the inner peripheral surface of the cylinder 132, and a couple of bushes 144 fit into the vane mount slot 132*h*, and the vane 143 integrally formed with the axis of rotation 141 and the roller 142 is inserted between the bushes 144. The cylinder 132 and the roller 142 define the compression chamber P (see FIG. 1) between them, with the compression chamber P (see FIG. 1) being divided by the vane 143 into a suction region S and a discharge region D. As noted earlier, the suction passages 142*a* (see FIG. 1) of the roller 142 are positioned in the suction region S, and the discharge port 133*a* (see FIG. 1) of the first cover 133 (see FIG. 1) is positioned in the discharge region D, with the suction passages 142*a* (see FIG. 1) of the roller 142 and the discharge port 133*a* (see FIG. 1) of the first cover 133 (see FIG. 1) being disposed to communicate with a discharge incline portion 136 contiguous with the vane 143. Therefore, the vane 143 which is integrally manufactured with the roller 142 in the present invention compressor and assembled to slidably movable between the bushes 144 can reduce frictional loss caused by the sliding contact and lower a refrigerant leak between the suction region S and the discharge region D more than a spring-supported vane which is manufactured separately from the roller or the cylinder in a conventional rotary compressor.

At this time, the rotation of the cylinder shape rotors 131 and 132 is transferred to the vane 143 formed at the second rotating member 143 so as to rotate the rotating member, and the bushes 144 inserted into the vane mount slot 132*h* oscillate, thereby enabling the cylinder shape rotors 131 and 132 and the second rotating member 140 to rotate together. While the cylinder 132 and the roller 142 rotate, the vane 143 makes a relatively linear reciprocating motion with respect to the vane mount slot 132*h* of the cylinder 132.

Therefore, when the rotor 131 receives a rotational force derived from the rotating electromagnetic field of the stator 120 (see FIG. 1), the rotor 131 and the cylinder 132 rotate. With the vane 143 being inserted into the cylinder 132, the rotational force of the rotor 131 and the cylinder 132 is transferred to the roller 142. Along the rotation of both, the vane 143 then linearly reciprocates between the bushes 144. That is, the rotor 131 and the cylinder 132 each have an inner surface corresponding to the outer surface of the roller 142, and these corresponding portions are repeatedly brought into contact with and separate from each other per rotation of the rotor 131/cylinder 132 and the roller 142. In so doing the suction region S gradually expands and refrigerant or a working fluid is sucked into it, while the discharge region D gradually shrinks at the same time to compress the refrigerant or working fluid therein and discharge it later.

To see how the suction, compression and discharge cycle of the compression mechanism part works, FIG. 5*a* shows a step of sucking refrigerant or a working fluid into the suction region S. For instance, a working fluid is being sucked in and immediately compressed in the discharge D. When the first and second rotating members 120 and 140 are arranged as shown in FIG. 5*b*, the working fluid is continuously sucked into the suction region S and compression proceeds accordingly. When the first and second rotating members 120 and 140 are arranged as shown in FIG. 5*c*, the working fluid is continuously sucked in, and the refrigerant or the working fluid of a preset pressure or higher in the discharge region D is discharged through the discharge incline portion (or discharge port) 136. Lastly, when the first and second rotating members 120 and 140 are arranged as shown in FIG. 5*d*, the compression and discharge of the working fluid are finished. In this way, one cycle of the compression mechanism part is completed.

Figure 6:
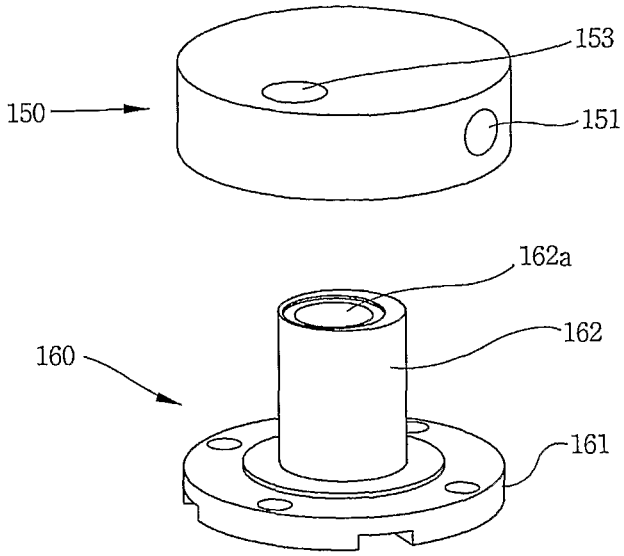
FIG. 6 is an exploded perspective view showing one example of a support member of the compressor in accordance with the first embodiment of the present invention.

FIG. 6 is an exploded perspective view showing an example of a support member of the compressor in accordance with the present invention.

As shown in FIGS. 1 and 6, the first and second rotating members 130 and 140 described earlier are rotatably supported on the inside of the hermetic container 110 by the first and second bearings 150 and 160 that are coupled in the axial direction. The first bearing 150 can be secured with a fixing rib or a fixing protrusion projected from the upper shell 112, and the second bearing 160 can be bolt-fastened to the lower shell 113.

The first bearing 150 is constructed to adopt a journal bearing for rotatably supporting the outer peripheral surface of the axis of rotation 141 and the inner peripheral surface of the first cover 133, and a trust bearing for rotatably supporting the upper surface of the first cover 133. The first bearing 150 includes a suction guide passage 151 communicated with a suction passage 141*a* of the axis of rotation 141. The suction guide passage 151 is opened in communication with the interior of the hermetic container 110 to let the refrigerant having been sucked in through the suction tube 114 enter the hermetic container 110. Moreover, the first bearing 150 includes a discharge guide passage 152 which is opened in communication with the discharge port 133*a* of the first cover 133, with the discharge port 133*a* taking the form of a ring or an annular ring to accommodate a revolving orbit of the discharge port 133*a* of the first cover 133 so as to discharge the refrigerant coming out through the discharge port 133*a* of the first cover 133 via the discharge tube 115 even if the discharge port 133*a* of the first cover 133 is revolving. Of course, the discharge guide passage 152 includes a discharge tube mount hole 153 through which it can be connected directly to the discharge tube 115 for a direct discharge of the refrigerant outside.

The second bearing 160 is constructed to adopt a journal bearing for rotatably supporting the outer peripheral surface of the axis of rotation 141 and the inner peripheral surface of the second cover 134, and a trust bearing for rotatably supporting the lower surface of the roller 142 and the lower surface of the second cover 134. The second bearing 160 is composed of a planar shape support 161 that is bolt-fastened to the lower shell 113, and a shaft 162 disposed at the center of the support 161, with the shaft having an upwardly protruded hollow 162*a*. At this time, the center of the hollow 162*a* of the second bearing 160 is formed at a position eccentric from the center of the shaft 162 of the second bearing 160, with the center of the shaft 162 of the second bearing 160 being collinear with the rotation centerline of the first rotating member 130, the center of the hollow 162*a* of the second bearing 160 being collinear with the axis of rotation 141 of the second rotating member 140. That is to say, although the center line of the axis of rotation 141 of the second rotating member 140 can be formed eccentric with respect to the rotation center line of the first rotating member 130, it can also be formed concentrically along the longitudinal center line of the roller 142. More details are now provided below.

Figure 7:
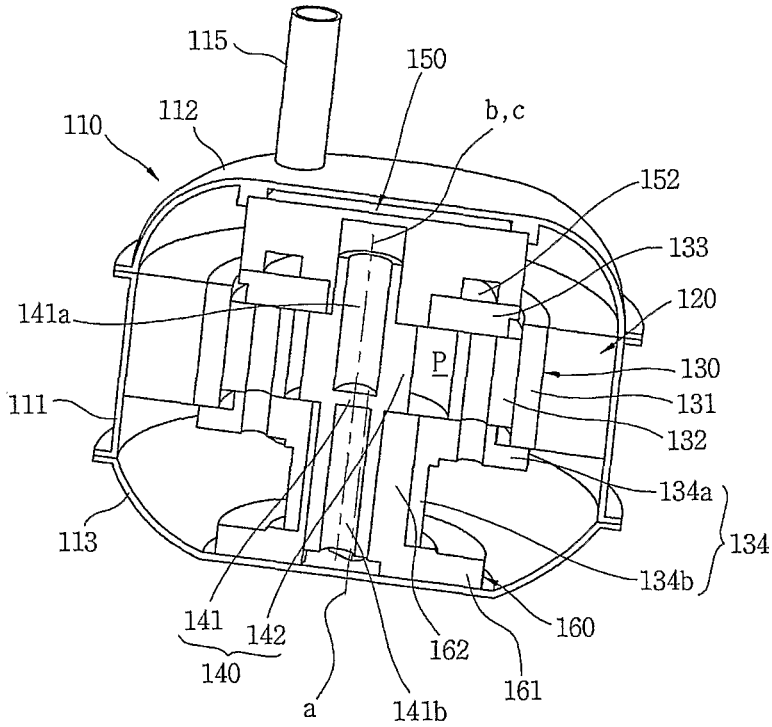
FIGS. 7 through 9 each illustrate a transverse cross-sectional view showing a rotation centerline of the compressor in accordance with the first embodiment of the present invention.
Figure 8:
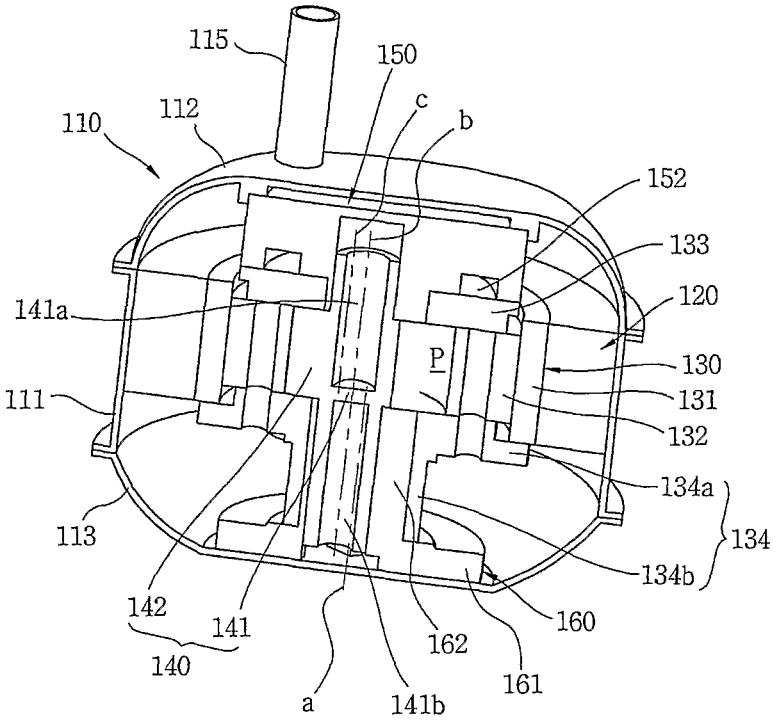
Figure 9:
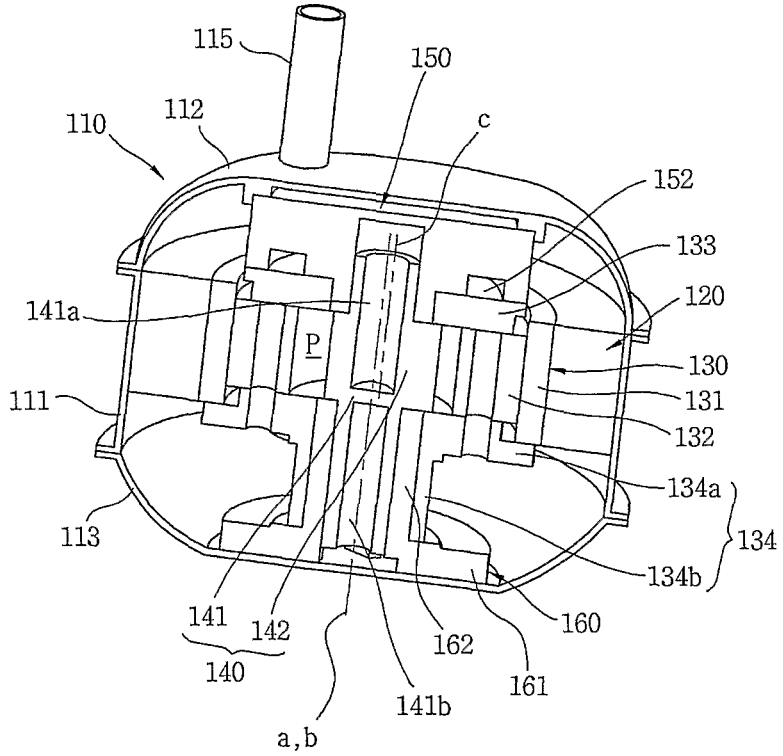

FIGS. 7 through 9 each illustrate a transverse cross-sectional view showing a rotation centerline of the compressor in accordance with the first embodiment of the present invention.

To enable the first and second rotating members 130 and 140 to compress refrigerant while rotating the second rotating member 140 is positioned eccentric with respect to the first rotating member 130. One example of relative positioning of the first and second rotating members 130 and 140 is illustrated in FIGS. 7 through 9. In the drawings, 'a' indicates a centerline of the first axis of rotation of the first rotating member 130, or a longitudinal centerline of the shaft 134*b* of the second cover 134, or a longitudinal centerline of the shaft 162 of the bearing 160. Here, because the first rotating member 130 includes the rotor 131, the cylinder 132, the first cover 133 and the second cover 134 as shown in FIG. 3, with all the elements rotating together en bloc, 'a' may be regarded as the rotation centerline of them, 'b' indicates a centerline of the second axis of rotation of the second rotating member 140 or a longitudinal centerline of the axis of the rotation 142, and 'c' indicates a longitudinal centerline of the second rotating member 140 or a longitudinal centerline of the roller 142.

As for the preferred embodiment of the present invention illustrated in FIGS. 1 through 6, FIG. 7 shows that the centerline 'b' of the second axis of rotation is spaced apart a predetermined distance from the centerline 'a' of the first axis of rotation, and the longitudinal centerline 'c' of the second rotating member 140 is collinear with the centerline 'b' of the second axis of rotation. In this way, the second rotating member 140 is disposed eccentric with respect to the first rotating member 130, and when the first and second rotating members 130 and 140 rotate together by the medium of the vane 143, they repeatedly contact, separate, and retouch per rotation as explained before, thereby varying the volume of the suction region S/the discharge region D so as to compress refrigerant within the compression chamber P.

FIG. 8 shows that the centerline 'b' of the second axis of rotation is spaced apart a predetermined distance from the centerline 'a' of the first axis of rotation, and the longitudinal centerline 'c' of the second rotating member 140 is spaced apart a predetermined distance from the centerline 'b' of the second axis of rotation, but the centerline 'a' of the first axis of rotation and the longitudinal centerline 'c' of the second rotating member 140 are not collinear. Similarly, the second rotating member 140 is disposed eccentric with respect to the first rotating member 130, and when the first and second rotating members 130 and 140 rotate together by the medium of the vane 143, they repeatedly contact, separate, and retouch per rotation as explained before, thereby varying the volume of the suction region S/the discharge region D so as to compress refrigerant within the compression chamber P. As such, a larger eccentric amount than that in FIG. 7 can be given.

FIG. 9 shows that the centerline 'b' of the second axis of rotation is collinear with the centerline 'a' of the first axis of rotation, and the longitudinal centerline 'c' of the second rotating member 140 is spaced apart a predetermined distance from the centerline 'a' of the first axis of rotation and from the centerline 'b' of the second axis of rotation. Similarly, the second rotating member 140 is disposed eccentric with respect to the first rotating member 130, and when the first and second rotating members 130 and 140 rotate together by the medium of the vane 143, they repeatedly contact, separate, and retouch per rotation as explained before, thereby varying the volume of the suction region S/the discharge region D so as to compress refrigerant within the compression chamber P.

Figure 10:
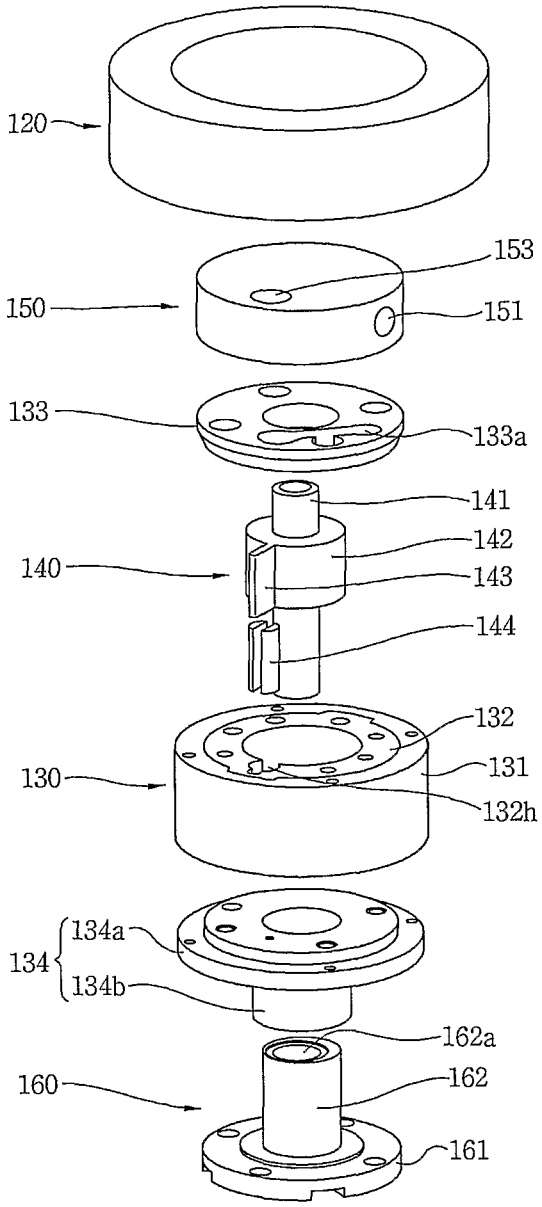
FIG. 10 is an exploded perspective view showing the compressor in accordance with the first embodiment of the present invention.

FIG. 10 is an exploded perspective view showing a compressor in accordance with one embodiment of the present invention.

To see an example of how the compressor according to the first embodiment of the present invention is assembled by referring to FIGS. 1 and 10, the rotor 131 and the cylinder 132 are either manufactured separately and then coupled, or manufactured in one unit from the beginning. The axis of rotation 141, the roller 142 and the vane 143 can also be manufactured separately or integrally, but either way, they should be able to rotate as one unit. The vane 143 is inserted between the bushes 144 within the cylinder 131. Overall, the axis of rotation 141, the roller 142 and the vane 143 are mounted within the rotor 131 and the cylinder 132. The first and second covers 133 and 134 are bolt-fastened in the axial direction of the rotor 131 and the cylinder 132, with the covers covering the roller 142 even if the axis of rotation 141 may pass therethrough.

After a rotation assembly assembled with the first and second rotating members 130 and 140 are put together as described above, the second bearing 160 is bolt-fastened to the lower shell 113, and the rotation assembly is then assembled to the second bearing 160, with the inner circumferential surface of the shaft 134*a* of the second cover 134 circumscribing the outer circumferential surface of the shaft 162, with the outer circumferential surface of the axis of rotation 141 being inscribed in the hollow 162*a* of the second bearing 160. Next, the stator 120 is press fitted into the body 111, and the body 111 is joined to the upper shell 112, with the stator 120 being positioned to maintain an air-gap with the outer circumferential surface of the rotation assembly. After that, the first bearing 150 is joined or assembled to the upper shell 112 in a way that the discharge tube 115 of the upper shell 112 is press fitted into the discharge mount hole 153 (see FIG. 6) of the first bearing. As such, the upper shell 122 assembled with the first bearing 150 is joined to the body 111, and the first bearing 150 which is fitted between the axis of rotation 141 and the first cover 133 is covered above by the shell 112 at the same time. Needless to say, the suction guide passage 151 of the first bearing 150 is in communication with the suction passage 141*a* of the axis of rotation 141, and the discharge guide passage 152 of the first bearing 150 is in communication with the discharge port 133*a* of the first cover 133.

Therefore, with all of the rotation assembly assembled with the first and second rotating members 130 and 140, the body 111 mounted with the stator 120, the upper shell 112 mounted with the first bearing 150, and the lower shell 113 mounted with the second bearing 160 being joined in the axial direction, the first and second bearings 150 and 160 rotatably support the rotation assembly onto the hermetic container 110 in the axial direction.

Figure 11:
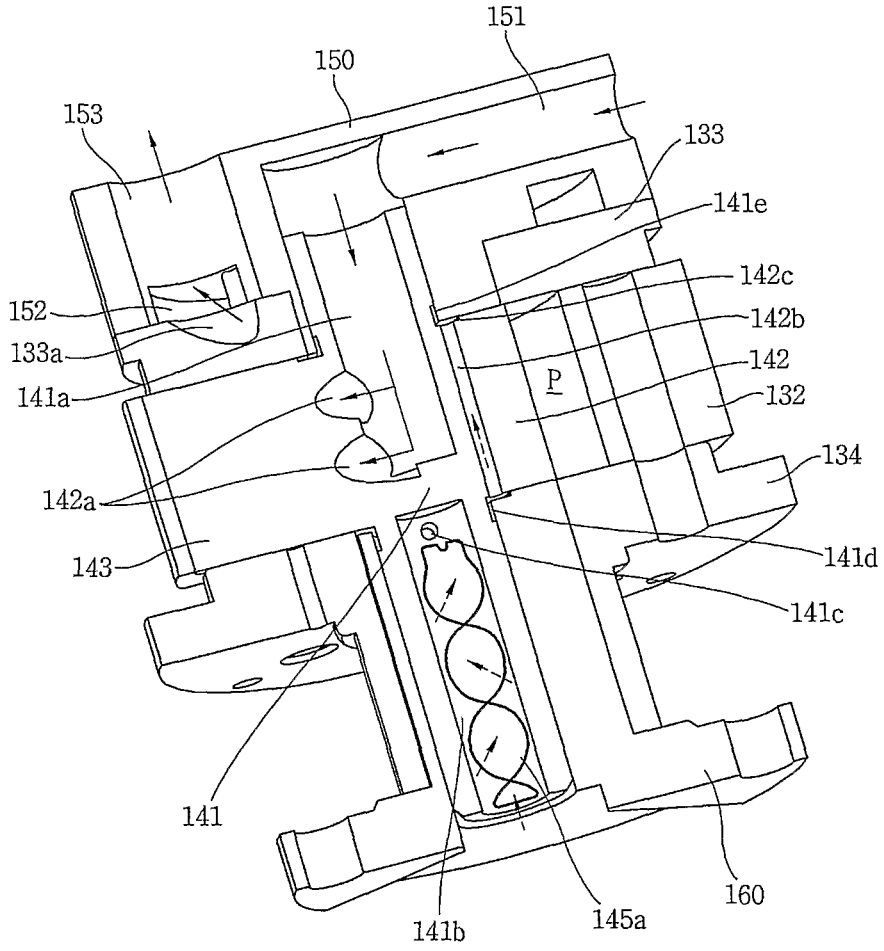
FIG. 11 is a transverse cross-sectional view showing how refrigerant and oil flow in the compressor in accordance with the first embodiment of the present invention.

FIG. 11 is a transverse cross-sectional view showing how refrigerant and oil flow in a compressor in accordance with one embodiment of the present invention.

To see how the first embodiment of the compressor of the present invention operates by referring to FIGS. 1 and 11, when electric current is fed to the stator 120, a rotating electromagnetic field is generated between the stator 120 and the rotor 131, and with the application of a rotational force from the rotor 131, the first rotating member 130, i.e., the rotor 131 and the cylinder 132, and the first and second covers 133 and 134 rotate together as one unit. As the vane is 134 is installed at the cylinder 131 to be able to linearly reciprocate, a rotational force of the first rotating member 130 is transferred to the second rotating member 140 so the second rotating member 140, i.e., the axis of rotation 141, the roller 142 and the vane 143, rotate together as one unit. As shown in FIGS. 7 through 9, because the first and second rotating members 130 and 140 are disposed eccentric with respect to each other, they repeatedly contact, separate, and retouch per rotation, thereby varying the volume of the suction region S/the discharge region D so as to compress refrigerant within the compression chamber P and to pump oil at the same time to lubricate between two slidingly contacting members.

During the rotation of the first and second rotating members 130 and 140, oil is supplied to sliding contact portions between the bearings 150 and 160 and the first and second rotating members 130 and 140, or to sliding contact portions between the first rotating member 130 and the second rotating member 140, so as to lubricate between the members. To this end, the axis of rotation 141 is dipped into the oil that is stored at the lower area of the hermetic container 110, and any kind of oil feed passage for oil supply is provided to the second rotating member 140. In more detail, when the axis of rotation 141 starts rotating in the oil stored at the lower area of the hermetic container 110, the oil pumps up or ascends along the helical member 145 or groove disposed within an oil feeder 141*b* of the axis of the rotation 141 and escapes through an oil feed hole 141*c* of the axis of the rotation 141, not only to gather up at an oil storage cavity 141*d* between the axis of rotation 141 and the second bearing 160 but also to lubricate between the axis of rotation 141, the roller 142, the second bearing 160, and the second cover 134. The oil having been gathered up at the oil storage cavity 141*d* between the axis of rotation 141 and the second bearing 160 pumps up or ascends through the oil feed hole 142*b* of the roller 142, not only to gather up at oil storage cavities 141*e* and 142*c* between the axis of rotation 141, the roller 142 and the first bearing 150, but also to lubricate between the axis of rotation 141, the roller 142, the first bearing 150, and the first cover 133.

Figure 12:
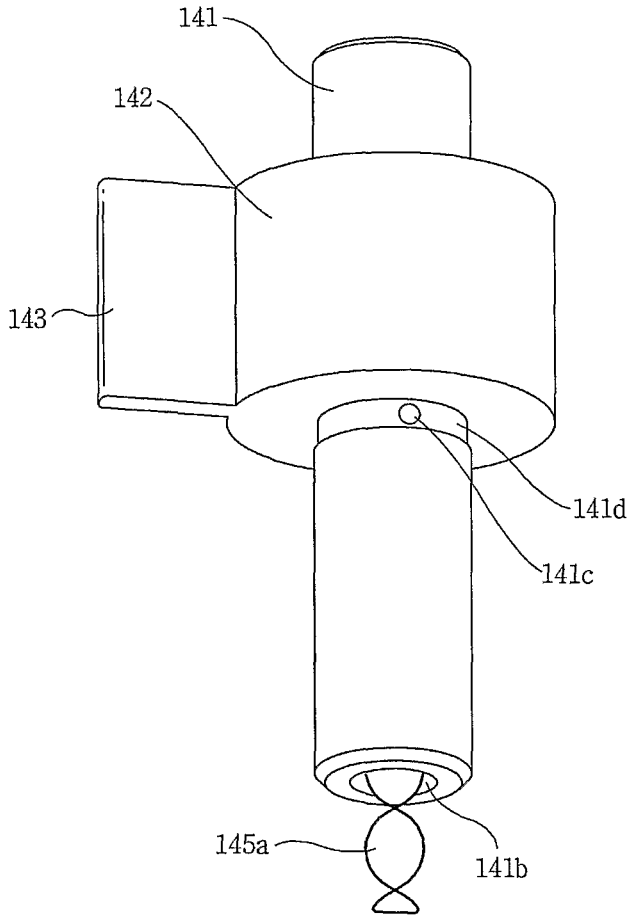
FIGS. 12 and 13 each illustrate a perspective view showing an example of the assembled structure of a roller and an oil feeder of the compressor in accordance with the first embodiment of the present invention.
Figure 13:
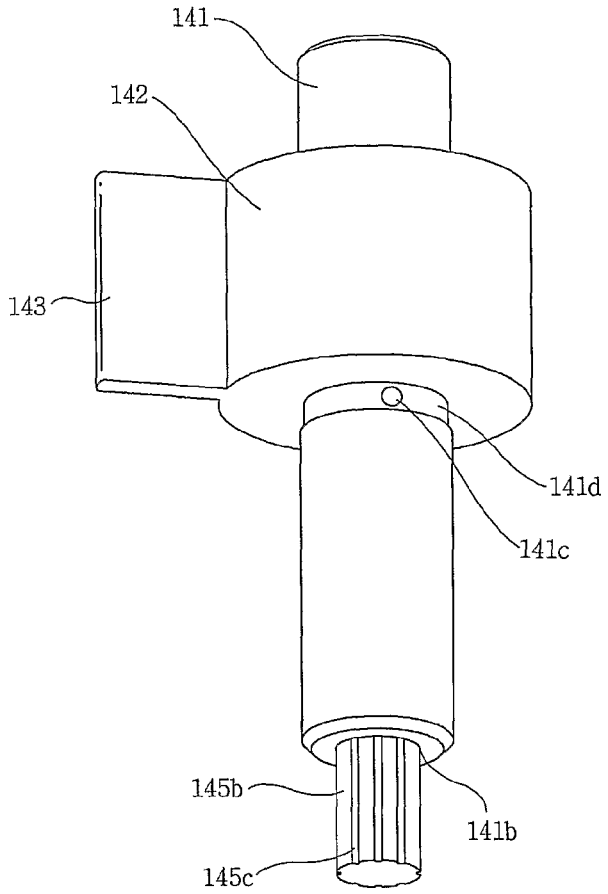

FIGS. 12 and 13 each illustrate a perspective view showing an example of the assembled structure of the roller 142 and oil feed members 145*a* and 145*b* of the compressor in accordance with the first embodiment of the present invention.

To see in more detail how oil is fed through the inside of the axis of rotation 141 by referring to FIG. 11, the bottom of the hermetic container 110 is filled up with oil, and with one end of the axis of rotation 141 being dipped into the oil, the oil is pumped up along the interior of the axis of rotation 141. From this standpoint, the bottom of the axis of rotation 141 is a start point of the oil feed passage, playing a role of an oil pump. In order for the axis of rotation 141 to make the oil move up against the gravity, an oil feed member 145*a* may be provided to the oil feeder 141*b* within the axis of rotation 141.

As for a preferred embodiment, the oil fee member 145*a* may take the form of a helical shape to function as a centrifugal pump for example. The helical oil feed member can be prepared by twisting a roughly rectangular board in a spiral form. In such case, the board may be twisted to the left or right to help the oil climb up along the face of the board according to the rotational direction of the axis of rotation 141. Besides the helical shape, the oil feed member may also take the form of a pillar shape with a helical groove formed in its outer circumferential surface, or a propeller shape. The helical oil feed member 145*a* rotates together with the axis of rotation 141 within the oil feeder 141*b* to pump up oil by the rotational force.

FIG. 13 shows yet another preferred embodiment of the oil feed member 145*b*, with the oil feeder 141*b* pumping up oil using a capillary phenomenon. To induce the capillary phenomenon, a pillar shape oil feed member 145*b* is press fitted into the oil feeder 141*b* within the axis of rotation 141, and plural grooves 145*c* with a diameter small enough for the capillary process to take place between the inner circumferential surface of the axis of rotation 141 and the oil feed member are formed. Needless to say, the grooves 145*c* may be formed in the inner circumferential surface of the oil feeder 141*b*, or one side of the oil feed member 145*b*, or both sides.

Moreover, there is provided an oil feed passage communicating with peripheral area and the roller 142 to evenly distribute the oil having been pumped up along the axis of rotation 141. As such, the oil feeder 141*b* has one end blocked to prevent the mixing of oil into the refrigerant in an area close to the roller 142 in the axial direction, and an oil feed hole 141*c* is drilled, passing through the axis of rotation 141 located contiguous with the roller 142. The oil flowing out through the oil feed hole 141*c* is fed between the outer circumferential surface of the axis of rotation 141 and the second bearing 160, and between the roller 142 and the second cover 134, thereby forming a film of a uniform thickness for lubrication. The second cover 134 has a collection cavity to collect the oil having been used for lubricating between the roller 142 and the contact surface to the bottom of the hermetic container 110.

In addition, an oil storage cavity 141*d* is formed between the axis of rotation 141 and the second bearing 160 to serve as a temporal reservoir of the oil flowing out from the oil feed hole 141*c*. Meanwhile, the roller 142 has an oil feed hole 142*b* that is drilled in the axial direction to be in communication with the oil storage cavity 141*d*. Thus, the rotational friction of the axis of rotation 141 is lubricated through oil in the oil storage cavity 141*e* that is formed between the outer circumferential surface of the axis of rotation 141 and the first bearing 150 at the upper portion of the roller, and the oil is temporarily collected in the oil storage cavity 142*c* between the roller 142 and the first bearing 150 and used later for lubricating the friction between the roller 142 and the first bearing 150 or the first cover 133.

Figure 14:
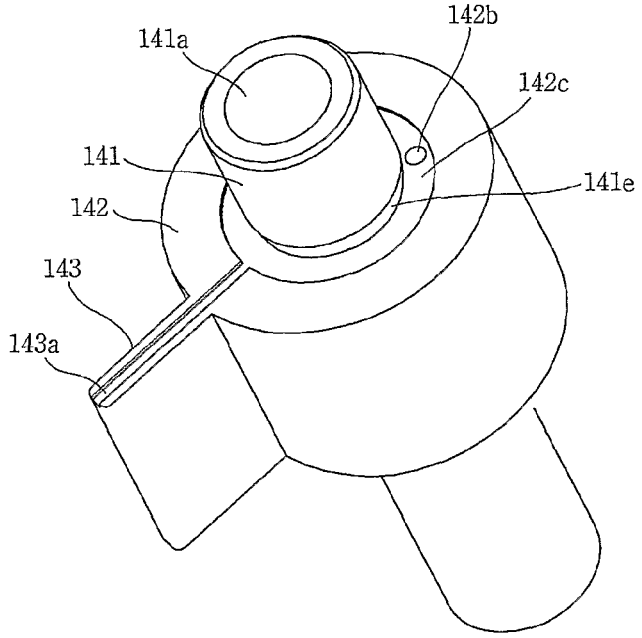
FIG. 14 is a perspective view of the roller with an oil feed structure for a vane and bushes of the compressor in accordance with the first embodiment of the present invention.

FIG. 14 shows one embodiment of the construction to feed oil to the vane 143 and the bushes 144 in accordance with the present invention, with the oil being fed between the vane 143 and the bushes 144 through an oil groove 143*a* or an oil hole. Preferably, the passage going through the vane 143 and the bushes 144 is formed extendedly from the oil storage cavity 142*c* placed contiguous with the upper portion of the roller of the axis of rotation 141. In so doing oil flows down, by the gravity, along the vane 143 and the bushes 144 from the upper side of the roller 141 evenly to achieve lubrication. Optionally, instead of adopting the above configuration, the bushes 144 may be made of natural-lubricating materials.

The refrigerant flow will now be explained in details based on FIGS. 1 and 9.

When the first and second rotating members 130 and 140 rotate by the medium of the vane 143, refrigerant is sucked in, compressed and discharged. In more detail, the roller 142 and the cylinder 132 repeatedly contact, separate, and retouch, thereby varying the volume of the suction region and the discharge region divided by the vane 143 within the compression chamber P so as to suck in, compress, and discharge refrigerant. That is to say, as the volume of the suction region gradually expands, refrigerant is sucked into the suction region of the compression chamber P through the suction tube 114 of the hermetic container 110, the interior of the hermetic container 110, the suction guide passage 151 of the first bearing 150, the suction passage 141*a* of the axis of rotation 141 and the suction passage 142*a* of the roller 142. Concurrently, as the volume of the discharge region gradually shrinks along the motions of the roller 142 and the cylinder 132, refrigerant is compressed, and when a discharge valve (not shown) is open at a pressure above the preset level the compressed refrigerant is then discharged in the direction of the first cover 133 through the discharge incline portion 136 (see FIG. 5). The discharged refrigerant eventually exits outside of the hermetic container 110 through the discharge port 133*b* of the first cover 133, the discharge guide passage 152 of the first bearing 150, and the discharge tube 115 of the hermetic container 110.

Figure 15:
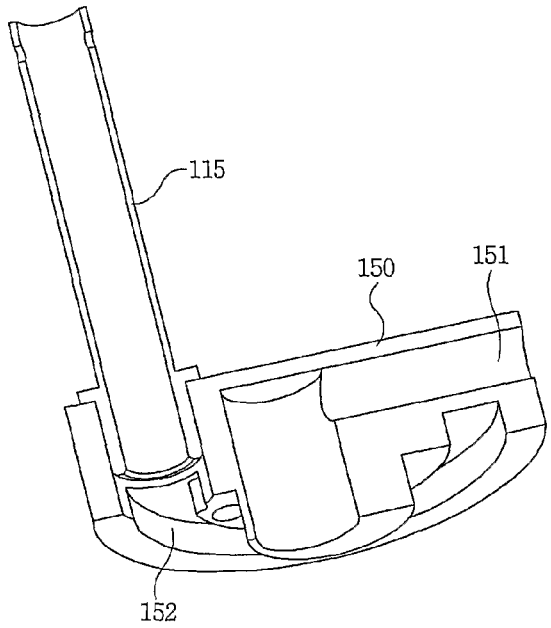
FIG. 15 is a transverse cross-sectional view showing a first bearing of the compressor in accordance with the first embodiment of the present invention.

FIG. 15 shows a cross section of the first bearing 150.

Refrigerant having passed through the suction guide passage 151 is sucked in axially through the suction passage 141*a* (see FIG. 11) which is the hollow shaft portion on the upper side of the roller 142 (see FIG. 11) and undergoes the compression process in the compression chamber P as described above. The refrigerant having gone through the compression process passes the discharge port 133*a* (see FIG. 11) of the first cover 133 (see FIG. 11) and is discharged to the discharge tube 115 via the discharge guide passage 152. Referring to FIG. 11, because the first bearing 150 supports the motion of the axis of rotation 141 of the roller 142, to accommodate the compressed refrigerant being discharged through the discharge port 133*a* (see FIG. 11), the discharge guide passage 152 creates a space circumscribing the axis of rotation 141. The space created by the discharge guide passage 152 may function as a muffler for reducing noise associated with the refrigerant compression.

In reference to FIGS. 16 through 24, the following now explains in detail about a compressor in accordance with a second embodiment of the present invention.

Figure 16:
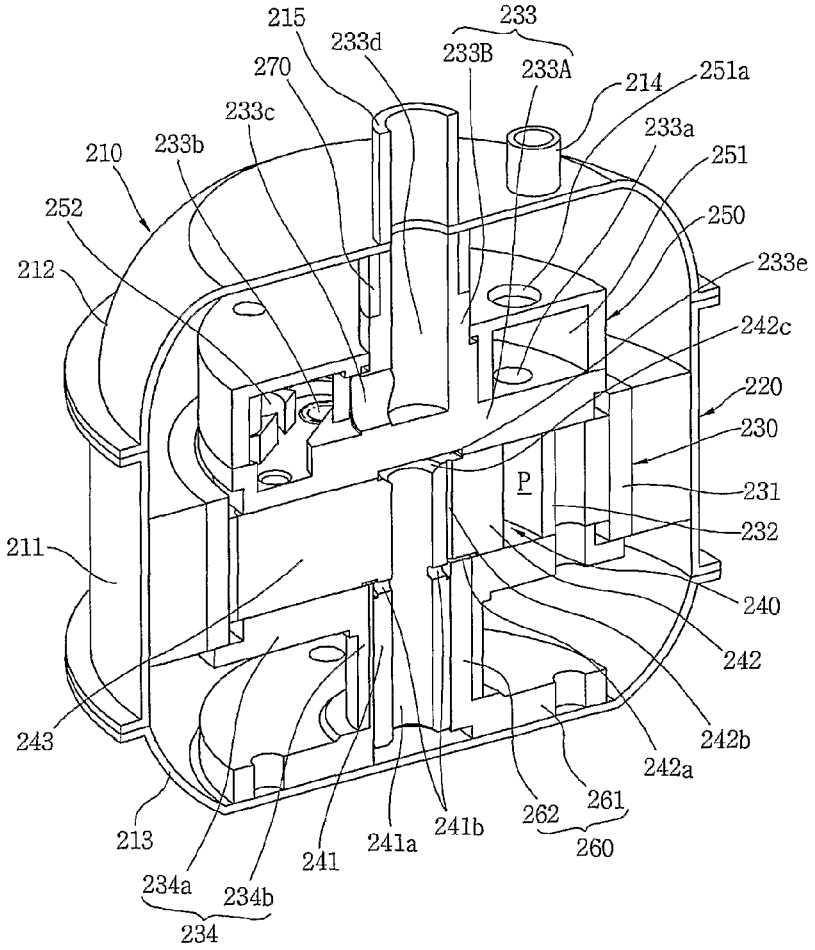
FIG. 16 is a transverse cross-sectional view showing a compressor in accordance with a second embodiment of the present invention.

FIG. 16 is a transverse cross-sectional view showing a compressor in accordance with the second embodiment of the present invention.

As shown in FIG. 16, the compressor in accordance with the second embodiment of the present invention includes a hermetic container 210, a stator 220 installed within the hermetic container 210, a first rotating member 230 installed within the stator 220 and rotating with an interaction with the stator 220, a second rotating member 240 rotating within the first rotating member 230 by a rotational force transferred from the first rotating member 230 for compressing refrigerant therebetween, a muffler 250 for guiding refrigerant suction/discharge to a compression chamber P between the first and second rotating members 230 and 240, a bearing 260 supporting the first and second rotating members 230 and 240 to be able to rotate within the hermetic container 210, and a mechanical seal 270. An electromotive mechanism part employs, for example, a BLDC motor including the stator 220 and the first rotating member 230, and a compression mechanism part includes the first and second rotating members 230 and 240, the muffler 250, the bearing 260 and the mechanical seal 270. Therefore, by increasing inner diameter of the electromotive mechanism part instead of reducing its height, the compression mechanism part can be arranged within the electromotive mechanism part, thereby lowering the total height of the compressor. The hermetic container 210 is composed of a cylinder-shaped body 211, and upper/lower shells 212 and 213 coupled to the top/bottom of the body 211 and stores oil at a suitable height to lubricate or smooth the first and second rotating members 230 and 240. The upper shell 213 includes a suction tube 214 on one side for sucking refrigerant, and a discharge tube 215 at the center for discharging refrigerant. Here, whether a compressor is a high-pressure type compressor or a low-pressure type compressor is determined depending on the connection structure of the suction tube 214 and the discharge tube 215. This particular embodiment of the invention introduces a low pressure compressor, wherein the suction tube 214 is connected to the hermetic container 210 and the discharge tube 215 is connected directly to the compression mechanism part. Thus, when a low-pressure refrigerant is sucked in through the suction tube 214, it fills the interior of the hermetic container 210 and flows into the compression mechanism part through the suction tube 215.

The stator 220 is composed of a core 221, and a coil 222 primarily wound around the core 221. Since the stator 220 has the same construction with the compressor stator in accordance with the first embodiment of the present invention, it will not be explained here.

Figure 17:
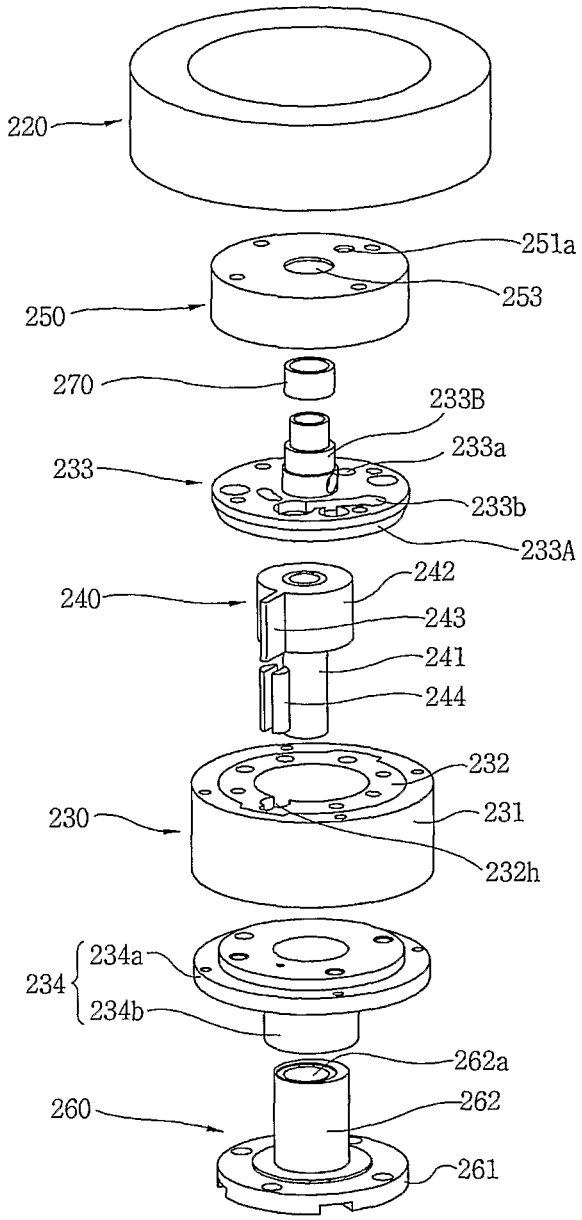
FIG. 17 is an exploded perspective view showing the compressor in accordance with the second embodiment of the present invention.

FIG. 17 is an exploded perspective view showing the compressor in accordance with the second embodiment of the present invention.

The first rotating member 230, as shown in FIG. 17, is composed of a rotor 231, a cylinder 232, a shaft cover 233 and a cover 234. The rotor 231 has a cylindrical shape, with the rotor 231 rotating within the stator 220 by a rotating electromagnetic field generated from the stator 220, and inserted therethrough are plural permanent magnets (not shown) in an axial direction to generate a rotating magnetic field Similar to the rotor 231, the cylinder 232 also takes the form of a cylinder to create a compression chamber P inside. The rotor 231 and the cylinder 232 can be manufactured separately and joined together later, or can be integrally formed from the beginning.

The shaft cover 233 and the main cover 234 are coupled to the rotor 231 or the cylinder 232 in the axial direction, and the compression chamber P is defined between the cylinder 232 and the shaft cover 233 and the main cover 234. The shaft cover 233 is composed of a planar shape cover portion 233A for covering the upper surface of the roller 242, and a downwardly projecting hollow shaft 233B at the center. The cover portion 233A of the shaft cover 233 includes a suction port 233*a* for sucking in refrigerant therethrough, a discharge port 233*b* for discharging a compressed refrigerant therethrough from the compression chamber P, and a discharge valve (not shown) mounted thereon. The shaft 233B of the shaft cover 233 includes discharge guide passages 233*c* and 233*d* for guiding refrigerant to the outside of the hermetic container 210, with the refrigerant having been discharged through the discharge port 233*b* of the shaft cover 233. Also, the shaft 233B is designed to be inserted into the mechanical seal 270 by forming part of its outer circumferential surface at the tip. Similar to the shaft cover 233, the main cover 234 is composed of a planar shape cover portion 234*a* for covering the lower surface of the roller 242, and a downwardly projecting hollow shaft portion 234*b* at the center. Although the shaft portion 234*b* may be optionally omitted, its role in receiving a load acting thereon increases a contact area with the bearing 260 and give more stable support to the main cover 234. Since the shaft cover 233 and the main cover 234 are bolt-fastened to the rotor 231 or the cylinder 232 in the axial direction, the rotor 231, the cylinder 232, and the shaft cover and the main cover 233 and 234 rotate together as one unit. Moreover, the muffler 250, which includes a suction chamber 251 communicated with the suction port 233*a* of the shaft cover and a discharge chamber 252 communicated with the discharge port 233*b* and the discharge guide passages 233*c* and 233*d* of the shaft cover 233, with the suction chamber 251 being defined separately from the discharge chamber 252, is also joined in the axial direction of the shaft cover 233. Of course, the suction chamber 251 of the muffler 250 may be omitted, but it is better for the muffler 250 to have the suction chamber with the suction port 251*a* to be able to suck the refrigerant within the hermetic container 210 into the suction port 233*a* of the shaft cover 233.

The second rotating member 240 is composed of an axis of rotation 241, a roller 242, and a vane 243. The axis of rotation 241 is protrusively formed towards one side, i.e., lower surface, in the roller 242 axis direction. Because the axis of rotation 241 is protruded only from the lower surface, its protruded length is longer than that in the case where the axis of rotation is protruded from both the upper and lower surfaces so it can support the motion of the second rotating member more stably. Also, even if the axis of rotation 241 and the roller 242 may have been manufactured separately, they must join together to be able to rotate as one unit. The axis of rotation 241 takes the form of a hollow shaft passing through the inside of the roller 242, with the hollow being composed of an oil feeder 241*a* for pumping oil. Here, the oil feeder 241*a* of the axis of rotation 241 is provided with a helical member to assist oil ascending by a rotational force, or a groove to assist oil ascending by a capillary phenomenon. The axis of rotation 241 and the roller 242 each have all kinds of oil feed holes 241*b* and oil storage grooves 242*b* and oil storage cavities 242*a* and 242*c* for supplying oil from the oil feeder 241*a* into between two or more members subject to sliding interactions.

The vane mount structure and a running cycle of the cylinder 232 and the roller 242 are the same as those in the first embodiment.

The first and second rotating members 230 and 240 described earlier are rotatably supported on the inside of the hermetic container 210 by the bearing 260 and the mechanical seal 270 that are coupled in the axial direction. The bearing 260 is bolt-fastened to the lower shell 213, and the mechanical seal 270 is secured to the inside of the hermetic container 210 by welding or the like in communication with the discharge tube 215 of the hermetic container 210.

The mechanical seal 270 is a device for preventing a fluid leak because of the contact between a rapidly spinning shaft and a fixed element/rotatory element in general, and is disposed between the discharge tube 215 of the stationary hermetic container 210 and the rotating shaft 233B of the shaft cover 233. Here, the mechanical seal 270 rotatably supports the shaft cover within the hermetic container 210 and communicates the shaft 233B of the shaft cover 233 with the discharge tube 215 of the hermetic container 210, while preventing a refrigerant leak between them.

The bearing 260 is constructed to adopt a journal bearing for rotatably supporting the outer peripheral surface of the axis of rotation 241 and the inner peripheral surface of the main cover 234, and a trust bearing for rotatably supporting the lower surface of the roller 242 and the lower surface of the main cover 234. The bearing 260 is composed of a planar shape support 261 that is bolt-fastened to the lower shell 213, and a shaft 262 disposed at the center of the support 261, with the shaft having an upwardly protruded hollow 262*a* (see FIG. 17). At this time, the center of the hollow 262*a* of the bearing 260 is formed at a position eccentric from the center of the shaft 262 of the bearing 260, or may be collinear with the center of the shaft 262 of the bearing 260 depending on whether the roller 242 is formed eccentric. More details are now provided below.

Figure 18:
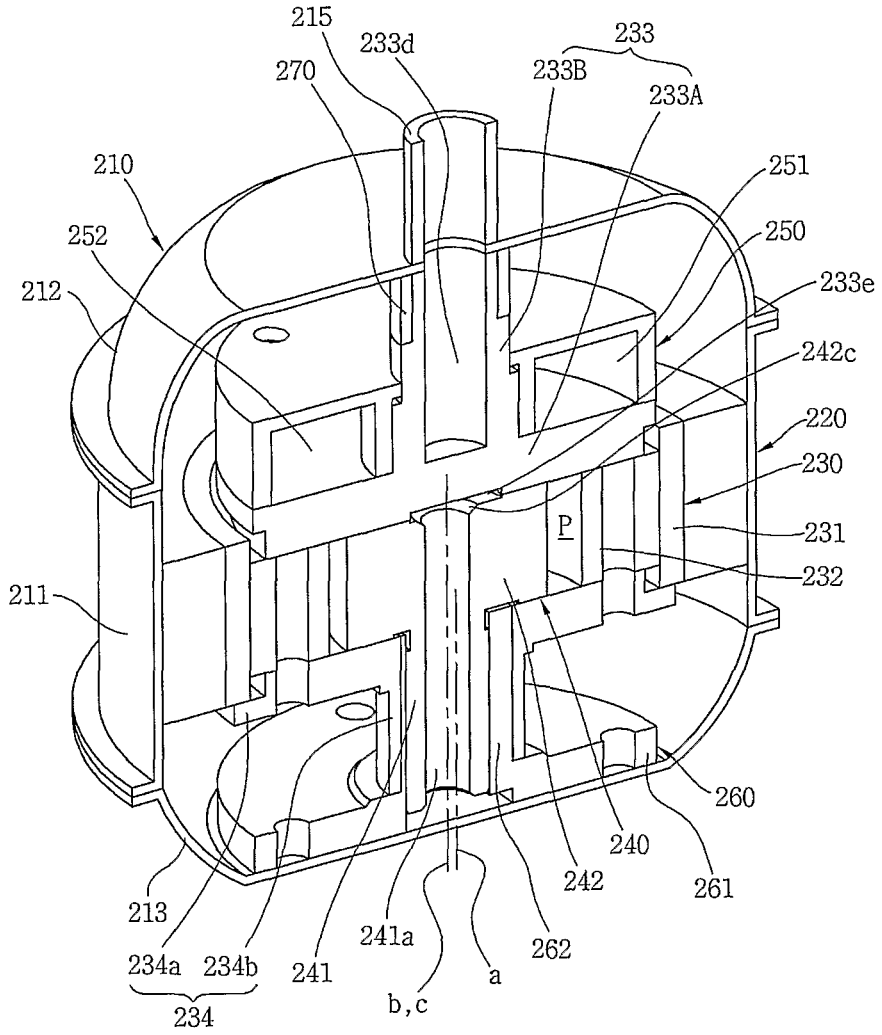
FIGS. 18 through 20 each illustrate a transverse cross-sectional view showing a rotation centerline of the compressor in accordance with the second embodiment of the present invention.
Figure 19:
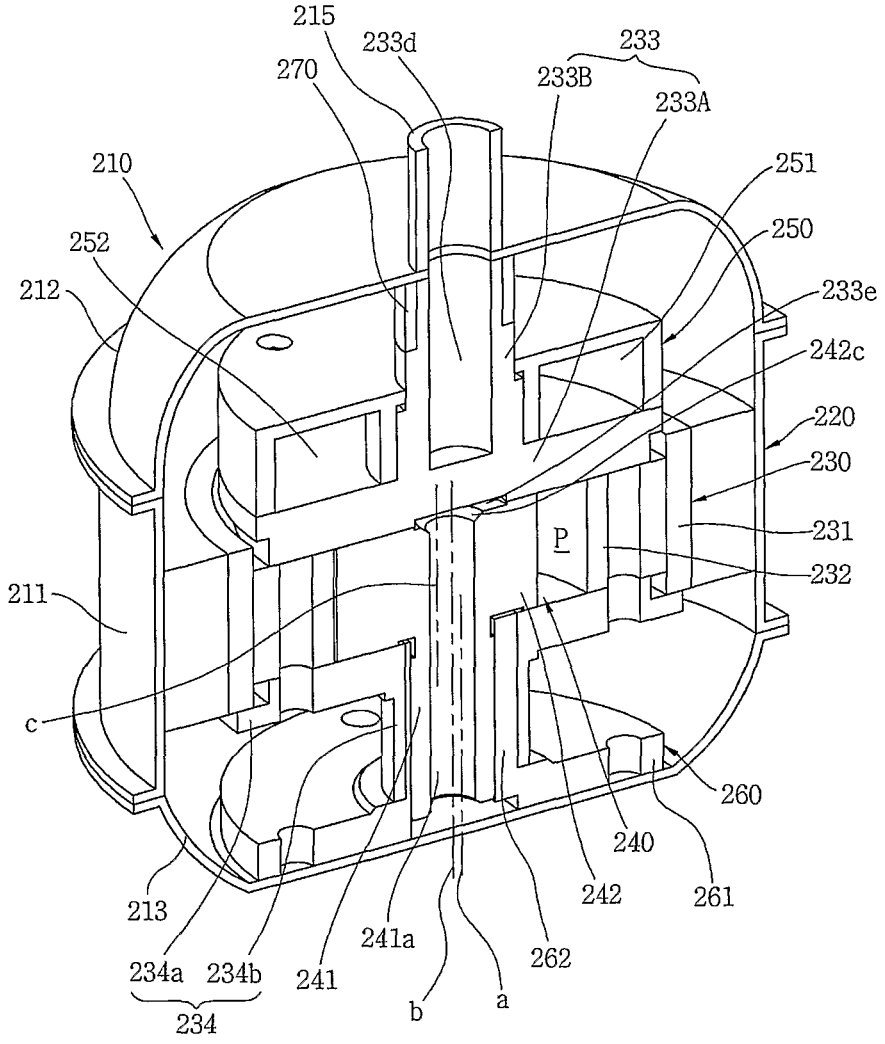
Figure 20:
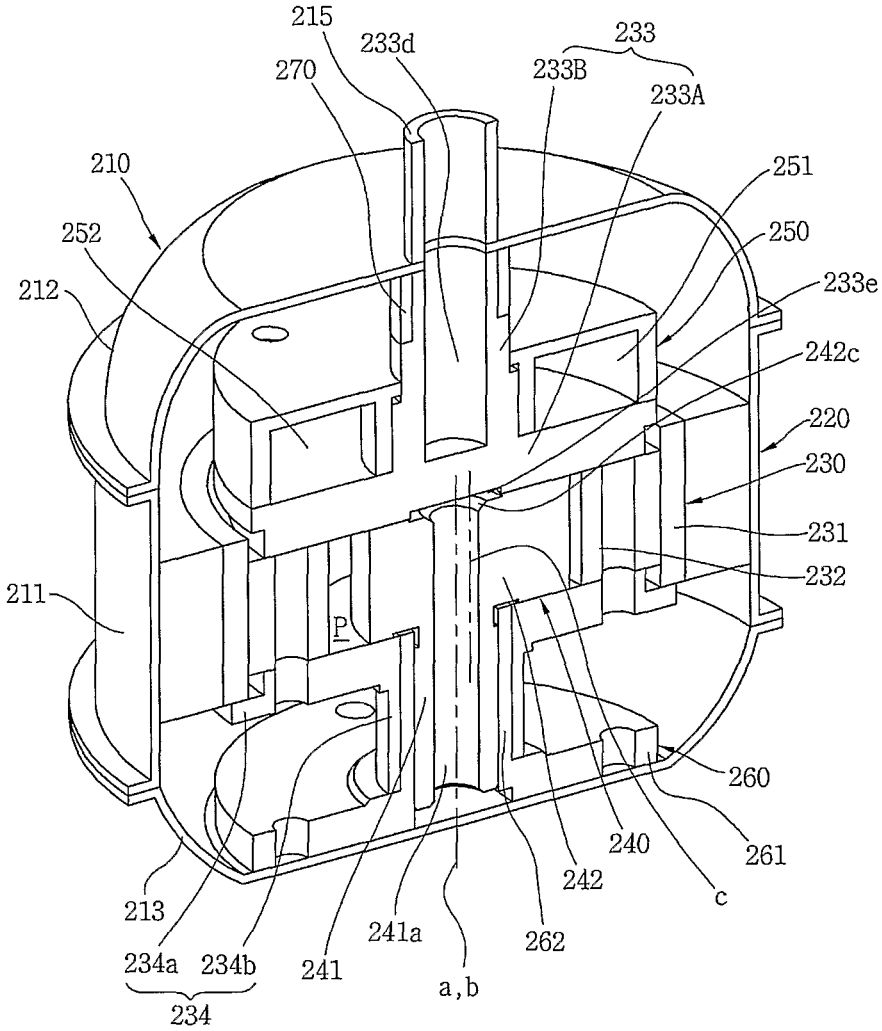

FIGS. 18 through 20 each illustrate a transverse cross-sectional view showing a rotation centerline of the compressor in accordance with the second embodiment of the present invention.

To enable the first and second rotating members 230 and 240 to compress refrigerant while rotating the second rotating member 240 is positioned eccentric with respect to the first rotating member 230. One example of relative positioning of the first and second rotating members 230 and 240 is illustrated in FIGS. 18 through 20. In the drawings, 'a' indicates a centerline of the first axis of rotation of the first rotating member 230, or it may be regarded as a longitudinal centerline of the shaft 234*b* of the main cover 234, or a longitudinal centerline of the shaft 262 of the bearing 260. Here, because the first rotating member 230 includes the rotor 231, the cylinder 232, the shaft cover 233 and the main cover 234 as shown in this embodiment, with all the elements rotating together en bloc, 'a' may be regarded as the rotation centerline of them, 'b' indicates a centerline of the second axis of rotation of the second rotating member 240 or a longitudinal centerline of the axis of the rotation 241, and 'c' indicates a longitudinal centerline of the second rotating member 240 or a longitudinal centerline of the roller 242.

FIG. 18 shows that the centerline 'b' of the second axis of rotation is spaced apart a predetermined distance from the centerline 'a' of the first axis of rotation, and the longitudinal centerline 'c' of the second rotating member 240 is collinear with the centerline 'b' of the second axis of rotation. In this way, the second rotating member 240 is disposed eccentric with respect to the first rotating member 230, and when the first and second rotating members 230 and 240 rotate together by the medium of the vane 243, they repeatedly contact, separate, and retouch per rotation as explained before, thereby compressing refrigerant within the compression chamber, as in this embodiment.

FIG. 19 shows that the centerline 'b' of the second axis of rotation is spaced apart a predetermined distance from the centerline 'a' of the first axis of rotation, and the longitudinal centerline 'c' of the second rotating member 240 is spaced apart a predetermined distance from the centerline 'b' of the second axis of rotation, but the centerline 'a' of the first axis of rotation and the longitudinal centerline 'c' of the second rotating member 240 are not collinear. Similarly, the second rotating member 240 is disposed eccentric with respect to the first rotating member 230, and when the first and second rotating members 230 and 240 rotate together by the medium of the vane 243, they repeatedly contact, separate, and retouch per rotation as explained before in the first embodiment, thereby compressing refrigerant within the compression chamber, as in this embodiment.

FIG. 20 shows that the centerline 'b' of the second axis of rotation is collinear with the centerline 'a' of the first axis of rotation, and the longitudinal centerline 'c' of the second rotating member 240 is spaced apart a predetermined distance from the centerline 'a' of the first axis of rotation and from the centerline 'b' of the second axis of rotation. Similarly, the second rotating member 240 is disposed eccentric with respect to the first rotating member 230, and when the first and second rotating members 230 and 240 rotate together by the medium of the vane 243, they repeatedly contact, separate, and retouch per rotation as explained before in the first embodiment, thereby compressing refrigerant within the compression chamber, as in this embodiment.

To see an example of how the compressor according to one embodiment of the present invention is assembled by referring to FIGS. 16 and 17, the rotor 231 and the cylinder 232 are either manufactured separately and then coupled, or manufactured in one unit from the beginning. The axis of rotation 241, the roller 242 and the vane 243 can also be manufactured separately or integrally, but either way, they should be able to rotate as one unit. The vane 243 is inserted between the bushes 244 within the cylinder 231. Overall, the axis of rotation 241, the roller 242 and the vane 243 are mounted within the rotor 231 and the cylinder 232. The shaft cover 233 and the main cover 234 are bolt-fastened in the axial direction of the rotor 231 and the cylinder 232, with the shaft cover 233 covering the upper surface of the roller 242 while the main cover 234 covering the roller 242 even if the axis of rotation 241 may pass through the main cover 234. In addition, the muffler 250 is bolt-fastened in the axial direction of the shaft cover 233, with the shaft 233B of the shaft cover 233 fitting into a shaft cover mount hole 253 of the muffler 250 to pass through the muffler 250. To prevent a refrigerant leak between the shaft cover 233 and the muffler 250, a separate sealing member (not shown) may be provided additionally to the joint area between the shaft cover 233 and the muffler 250.

After a rotation assembly assembled with the first and second rotating members 230 and 240 are put together as described above, the bearing 260 is bolt-fastened to the lower shell 213, and the rotation assembly is then assembled to the bearing 260, with the inner circumferential surface of the shaft 234*a* of the main cover 234 circumscribing the outer circumferential surface of the shaft 262 of the bearing 260, with the outer circumferential surface of the axis of rotation 241 being inscribed in the hollow 262*a* of the bearing 260. Next, the stator 220 is press fitted into the body 211, and the body 211 is joined to the upper shell 212, with the stator 220 being positioned to maintain an air-gap with the outer circumferential surface of the rotation assembly. After that, the mechanical seal 270 is assembled within the upper shell 212 in a way that it is communicated with the discharge tube 215, and the upper shell 212 having the mechanical seal 270 being secured thereon is joined to the body 211, with the mechanical seal 270 being inserted into a stepped portion on the outer circumferential surface of the shaft 233B of the shaft cover 233. Of course, the mechanical seal 270 is assembled to enable the communication between the shaft 233B of the shaft cover 233 and the discharge tube 215 of the upper shell 212.

Therefore, with all of the rotation assembly assembled with the first and second rotating members 230 and 240, the body 211 mounted with the stator 220, the upper shell 212 mounted with the mechanical seal 270, and the lower shell 213 mounted with the bearing 260 being joined in the axial direction, the mechanical seal 270 and the bearing 260 rotatably support the rotation assembly onto the hermetic container 210 in the axial direction.

Figure 21:
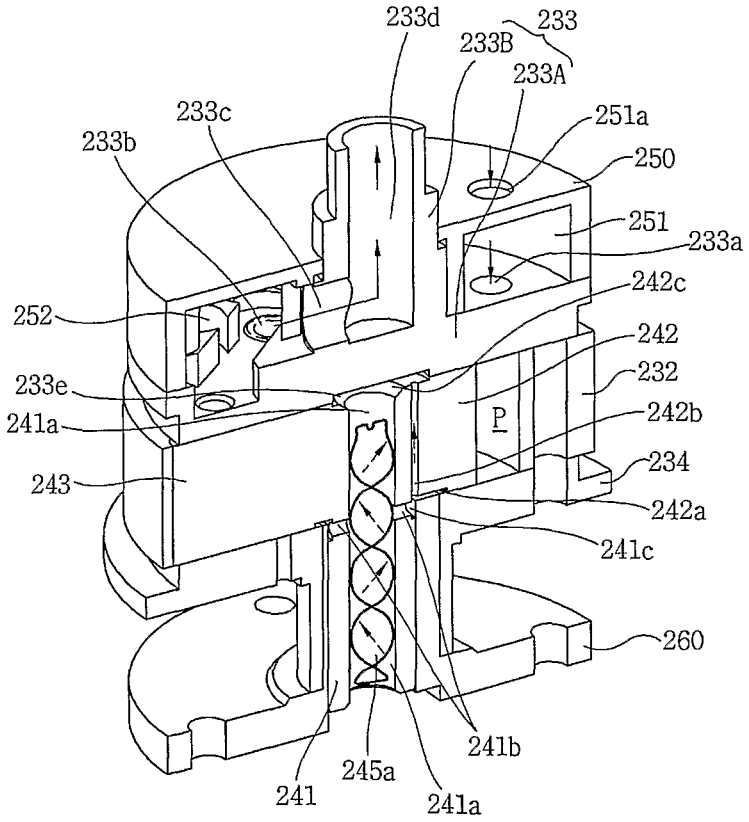
FIG. 21 is a transverse cross-sectional view showing how refrigerant and oil flow in the compressor in accordance with the second embodiment of the present invention.

FIG. 21 is a transverse cross-sectional view showing how refrigerant and oil flow in the compressor in accordance with the second embodiment of the present invention.

To see how the compressor according to the second embodiment of the present invention operates by referring to FIGS. 16 and 21, when electric current is fed to the stator 220, a rotating electromagnetic field is generated between the stator 220 and the rotor 231, and with the application of a rotational force from the rotor 231, the first rotating member 230, i.e., the rotor 231 and the cylinder 232, and the shaft cover 233 and the main cover 234 rotate together as one unit. As the vane is 234 is installed at the cylinder 231 to be able to linearly reciprocate, a rotational force of the first rotating member 230 is transferred to the second rotating member 240 so the second rotating member 240, i.e., the axis of rotation 241, the roller 242 and the vane 243, rotate together as one unit. As shown in FIGS. 18 through 20, because the first and second rotating members 230 and 240 are disposed eccentric with respect to each other, they repeatedly contact, separate, and retouch, thereby varying the volume of the suction region/the discharge region divided by the vane 243 so as to compress refrigerant and to pump oil at the same time to lubricate between two slidingly contacting members.

Moreover, during the rotation of the first and second rotating members 230 and 240, oil is supplied to sliding contact portions between the bearing 260 and the first and second rotating members 230 and 240 to lubricate between the members. To this end, the axis of rotation 241 is dipped into the oil that is stored at the lower area of the hermetic container 210, and any kind of oil feed passage for oil supply is provided to the second rotating member 240. In more detail, when the axis of rotation 241 starts rotating while being dipped in the oil stored at the lower area of the hermetic container 210, the oil pumps up or ascends along the helical member 245*a* or grooves 245*c* disposed within an oil feeder 241*a* of the axis of the rotation 241 and flows out through an oil feed hole 241*b* of the axis of the rotation 241, not only to gather up at an oil storage cavity 241*c* between the axis of rotation 241 and the bearing 260, but also to lubricate between the axis of rotation 241, the roller 242, the bearing 260, and the main cover 234. Also, the oil having been gathered up at the oil storage cavity 241*c* between the axis of rotation 241 and the bearing 260 pumps up or ascends through the oil feed hole 242*b* of the roller 242, not only to gather up at oil storage cavities 233*e* and 242*c* between the axis of rotation 241, the roller 242 and the first cover 233, but also to lubricate between the axis of rotation 241, the roller 242, the shaft cover 233.

Figure 22:
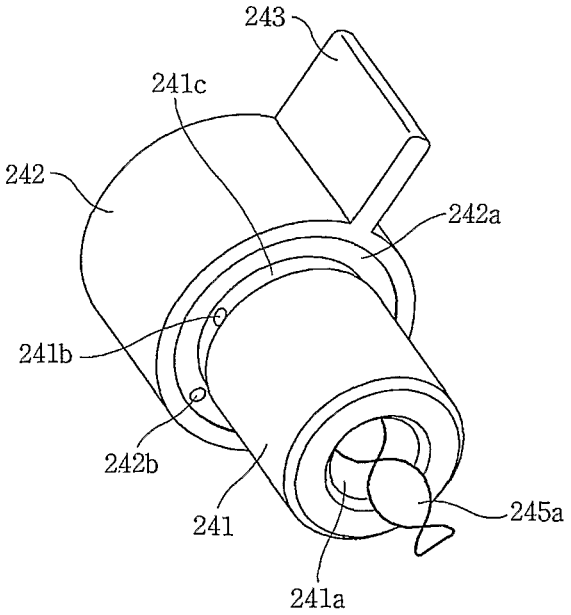
FIGS. 22 and 23 each illustrate a perspective view showing an example of the assembled structure of a roller and an oil feeder of the compressor in accordance with the second embodiment of the present invention.
Figure 23:
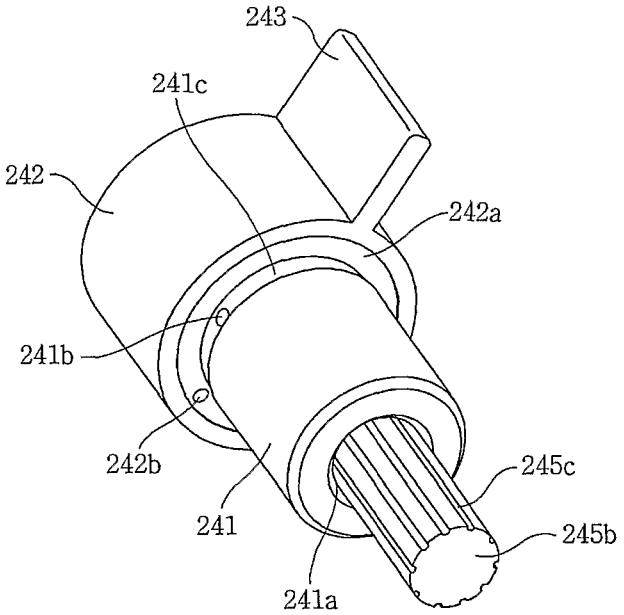

FIGS. 22 and 23 each illustrate a perspective view of an example of how the roller 242 and the oil feed member 245 are assembled in the compressor in accordance with the second embodiment of the present invention.

To see in more detail how oil is fed through the inside of the axis of rotation 241 by referring to FIG. 21, the bottom of the hermetic container 210 is filled up with oil, and with one end of the axis of rotation 241 being dipped into the oil, the oil is pumped up along the interior of the axis of rotation 241. From this standpoint, the bottom of the axis of rotation 241 is a start point of the oil feed passage, playing a role of an oil pump. In order for the axis of rotation 241 to make the oil move up against the gravity, an oil feed member 245*a* may be provided to the oil feeder 241*b* within the axis of rotation 241.

As for a preferred embodiment, the oil fee member 245*a* may take the form of a helical shape to function as a centrifugal pump for example. The helical oil feed member can be prepared by twisting a roughly rectangular board in a spiral form. In such case, the board may be twisted to the left or right to help the oil climb up along the face of the board according to the rotational direction of the axis of rotation 241. Optionally, the oil feed member may also take the form of a pillar shape with a helical groove formed in its outer circumferential surface, or a propeller shape. The helical oil feed member 245*a* rotates together with the axis of rotation 141 within the oil feeder 241*b* to pump up oil by the rotational force.

FIG. 23 shows yet another preferred embodiment of the oil feed member 245*b*, with the oil feeder 241*a* pumping up oil using a capillary phenomenon. To induce the capillary phenomenon, a pillar shape oil feed member 245*b* is press fitted into the oil feeder 241*a* within the axis of rotation 241, and plural grooves 245*c* with a diameter small enough for the capillary process to take place between the inner circumferential surface of the axis of rotation 241 and the oil feed member are formed. Needless to say, the grooves 245*c* may be formed in the inner circumferential surface of the oil feeder 241*a*, or one side of the oil feed member 245*b*, or both sides.

Moreover, there is provided an oil feed passage communicating with peripheral area and the roller 242 to evenly distribute the oil having been pumped up along the axis of rotation 241. In this embodiment, a refrigerant suction passage is separately formed above the roller 242, with the axis of rotation 241 being integrally formed with the roller 241 underneath it, and an oil passage is formed on the lower side (i.e. below the roller 242 of the axis of rotation 241). In so doing the oil feeder 241*a* is arranged even in the interior of the roller 242 in the axial direction, and the roller has one end blocked inside. The blocked end of the roller may be covered by the cover portion 233A of the shaft cover 233, or the upper side of the roller may optionally be blocked. In this way, the oil feed hole 241*b* is drilled, radially passing through the axis of rotation 241 located contiguous with the lower side of the roller 242. The oil flowing out through the oil feed hole 241*c* is fed between the outer circumferential surface of the axis of rotation 241 and the second bearing 260, and between the roller 242 and the second cover 234, thereby forming an oil film of a uniform thickness for lubrication. The second cover 234 has a collection cavity to collect the oil having been used for lubricating between the roller 242 and the contact surface to the bottom of the hermetic container 210.

In addition, an oil storage cavity 241*c* is formed between the axis of rotation 241 and the second bearing 260 to serve as a temporal reservoir of the oil flowing out from the oil feed hole 241*b*. Meanwhile, the roller 242 has an oil feed hole 242*b* that is drilled in the axial direction to be in communication with the oil storage cavity 241*c*, so the oil is temporarily collected at the oil storage cavities 233*e* and 242*c* formed between the shaft cover 233 and the roller 233 and then used for lubrication of friction between the roller 242 and the shaft cover 233. In detail, the oil which is supplied directly from the oil feeder 241*a* and the oil which is supplied through the oil feed hole 242*b* are temporarily stored at the oil storage cavity 233*e* formed in the roller 242 and the oil storage cavity 242*c* formed in the shaft cover 233 contacting the roller 242, and then form an oil film between the roller 242 and the shaft cover 233 to lubricate the friction between them.

Optionally, it is possible to extend the oil feeder 242*a* of the compressor of the second embodiment of the present invention up to the height of a contact portion between the roller 242 and the shaft cover 233 and feed oil directly to the oil storage cavities 233*e* and 242*c*. In this case, the oil feed hole 242*b* may not necessarily drilled in the roller 242.

Figure 24:
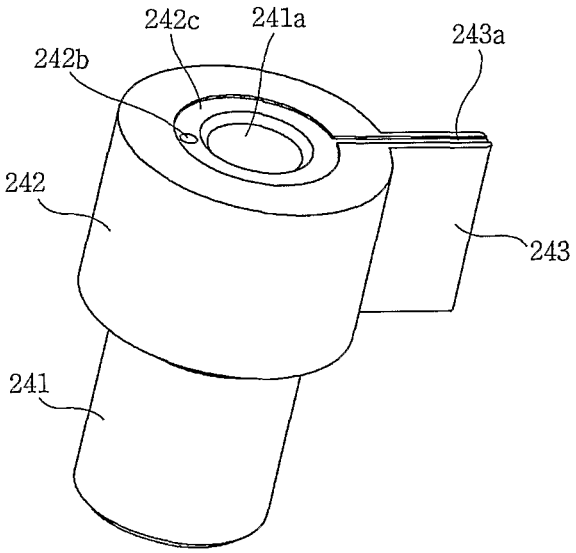
FIG. 24 is a perspective view of the roller with an oil feed structure for a vane and bushes of the compressor in accordance with the second embodiment of the present invention.

FIG. 24 shows one embodiment of the construction to feed oil to the vane 243 and the bushes 244 in accordance with the second embodiment of the present invention, with the oil being fed between the vane 243 and the bushes 244 through an oil groove 243*a* or an oil hole. Preferably, the passage going through the vane 243 and the bushes 244 is formed extendedly from the oil storage cavities 233*e* and 242*c* placed contiguous with the upper portion of the roller 242. In so doing oil flows down, by the gravity, along the vane 243 and the bushes 244 from the upper side of the roller 241 evenly to achieve lubrication. Optionally, instead of adopting the above configuration, the bushes 244 may be made of natural-lubricating materials.

According to this embodiment of the invention, because the roller 242, the cylinder 232, the shaft cover 233 and the main cover 234 rotate together, a frictional loss becomes small. In more detail, unlike the conventional techniques, the sliding contact between the cylinder 232 and the roller 242 is noticeably reduced by rotating the roller 242, the cylinder 232, the shaft cover 233 and the main cover 234 together with the rotor 231. Furthermore, the friction between the roller 242 and the shaft cover/cover 233/234 is relatively smaller than that of the conventional compressors. This is primarily because the roller 242 of the present invention compressor makes a translational motion at the contact surface with the shaft cover 233/cover 234, unlike the conventional roller making both rotational and translational motions between the covers. Thus, there is no need to extend the oil feed passage of the present invention compressor into the interior of the cylinder 232, and this assures that the oil will hardly mix with the refrigerant. If so, a separate installation of an accumulator can be omitted, and the compressor can be manufactured in a simple structure and with an enhanced operational reliability.

The refrigerant flow will now be explained in details based on FIGS. 16 and 21.

When the first and second rotating members 230 and 240 rotate by the medium of the vane 243, refrigerant is sucked in, compressed and discharged. In more detail, the roller 242 and the cylinder 232 repeatedly contact, separate, and retouch during the motion of the first and second rotating members 230 and 240, thereby varying the volume of the suction region and the discharge region divided by the vane 243 so as to suck in, compress, and discharge refrigerant. That is to say, as the volume of the suction region gradually expands according to the rotation of both, refrigerant is sucked into the suction region of the compression chamber P through the suction tube 214 of the hermetic container 210, the interior of the hermetic container 210, the suction port 251*a* and suction chamber 251 of the muffler 250, and the suction port 233*a* of the shaft cover 233.

With the refrigerant being sucked into the suction region, the volume of the discharge region gradually shrinks along the motions of the roller 242 and the cylinder 232, refrigerant is compressed, and when a discharge valve (not shown) is open at a pressure above the preset level the compressed refrigerant is then discharged in the direction of the shaft cover 233 through the discharge incline part 236 (see FIG. 17). The discharged refrigerant flows into the discharge chamber 252 of the muffler 250 through the discharge port 233*b* of the shaft cover 233. The noise level is reduced as the high-pressure refrigerant passes through the discharge chamber 252 of the muffler 250. The refrigerant flow inducing a lower noise is eventually exits outside of the hermetic container 210 through the discharge passages 233*c* and 233*d* formed in the shaft of the shaft cover 233, and the discharge tube 215 of the hermetic container 210.

With the compressor having the above configuration in accordance with the present invention, lubrication is done smoothly in presence of the oil feed passage at the contact surface between drive members. In addition, because the refrigerant suction passage and the refrigerant discharge passage circulate in separation from the oil circulation passage, it is possible to isolate the refrigerant passage from the oil passage. Accordingly, the possibility of the mixing of oil into refrigerant is minimized, and the compressor of high oil recovery can be provided. Besides, a much oil and refrigerant leak is reduced to thus guarantee an enhanced operational reliability.

Moreover, because the roller 142, 242, the cylinder 132, 232, and the cover 133, 134, 233, 234 according to the embodiment of the invention rotate together, a frictional loss becomes small. In more detail, unlike the conventional techniques, the sliding contact between the cylinder 132, 232 and the roller 142, 242 is noticeably reduced by rotating the roller 142, 242, the cylinder 132, 232, the cover 133, 134, 233, 234 together with the rotor 131, 231. In addition, the friction between the roller and the cover is relatively smaller than that of the conventional compressors. This is primarily because the roller of the present invention compressor makes a translational motion at the contact surface with the cover, unlike the conventional roller making both rotational and translational motions between the covers. Therefore, there is no need to extend the oil feed passage of the present invention compressor into the interior of the cylinder 132, 232, and this assures that the oil will hardly mix with the refrigerant. If so, a separate installation of an accumulator can be omitted, and the compressor can be manufactured in a simple structure and with an enhanced operational reliability.

The present invention has been described in detail with reference to the embodiments and the attached drawings.

However, the scope of the present invention is not limited to the embodiments and the drawings, but defined by the appended claims.

The invention claimed is:

1. A compressor, comprising:

a hermetic container that stores oil at a lower portion thereof, wherein a suction tube and a discharge tube are installed on the hermetic container;

a stator mounted within the hermetic container that generates a rotating electromagnetic field inside the stator;

a cylinder type rotor that is rotated within the stator by the rotating electromagnetic field of the stator and defines a compression chamber in the cylinder type rotor as well as within the stator, the cylinder type rotor comprising a first cover and a second cover secured to upper and lower portions thereof, respectively, that rotate integrally with the cylinder type rotor;

a roller that rotates within the compression chamber of the cylinder type rotor by a rotational force transferred from the cylinder type rotor and compresses a refrigerant during rotation;

a rotational shaft integrally formed with the roller, that extends in an axial direction of the roller;

a vane that divides the compression chamber into a suction region into which the refrigerant is sucked and a compression region in which the refrigerant is compressed and discharged from, the vane transferring the rotational force from the cylinder type rotor to the roller; and a plurality of oil feed passages provided in the rotational shaft and the roller, wherein one end of the rotational shaft is dipped into the oil at the lower portion of the hermetic container, the plurality of oil feed passages feeds the oil pumped from the lower portion of the hermetic container along an interior of the rotational shaft, by a rotating motion of the rotational shaft to a plurality of areas where two or more members selected from the first cover, the second cover, the cylinder type rotor, the roller, the rotational shaft, the vane, and bushes that guide the vane to make a linear reciprocating motion are slidingly engaged with one another, wherein a compressor assembly including the stator, the cylinder type rotor, the roller, the rotational shaft, and the vane is installed in the hermetic container with a gap at an inside space of the hermetic container, and wherein a low-pressure refrigerant is sucked into the inside space of the hermetic container through the suction tube and is then sucked into the suction region from the inside space of the hermetic container, and a high-pressure refrigerant compressed in the compression region is discharged outside of the hermetic container through the discharge tube, which communicates with the compression region.

2. The compressor according to claim 1, wherein the rotational shaft extends from both axial sides of the roller, wherein the first and second covers are joined to the cylinder type rotor in the axial direction, wherein the first and second covers define the compression chamber therebetween and receive the rotational shaft therethrough, and wherein first and second bearings are joined to the first and second covers, respectively, to rotatably support the rotational shaft, the roller, and the first and second covers onto the hermetic container.

3. The compressor according to claim 2, wherein the plurality of oil feed passages comprises an oil feeder formed within the one end of the rotational shaft that protrudes from one side of the roller in the axial direction of the roller, and a first oil feed hole that radially passes through a portion of the rotational shaft and which is contiguous with the roller to be in communication with the oil feeder.

4. The compressor according to claim 3, wherein the plurality of oil feed passages further comprises a plurality of first oil storage cavities formed in the rotational shaft having the first oil feed hole in one axial side of the roller, and wherein the roller is connected to the rotational shaft, so as to temporarily collect the oil supplied through the first oil feed hole.

5. The compressor according to claim 4, wherein the plurality of oil feed passages further comprises a second oil feed hole that axially passes through the roller to be in communication with the plurality of first oil storage cavities, and a second oil storage cavity formed in the other axial side of the roller having the second oil feed hole in the rotational shaft connected thereto so as to temporarily collect the oil supplied through the second oil feed hole.

6. The compressor according to claim 5, wherein the second oil storage cavity is formed to lubricate a bearing in contact with the rotational shaft and the other axial side of the roller.

7. The compressor according to claim 3, wherein the plurality of oil feed passages are mounted with an oil feed member that pumps the oil up to the oil feeder, and wherein the oil feed member is twisted in a spiral shape.

8. The compressor according to claim 3, wherein the oil feeder comprises an oil feed pillar located within the rotational shaft, such that the oil feeder feeds the oil through the plurality of oil feed passages by a capillary phenomenon.

9. The compressor according to claim 8, wherein the oil feeder includes a groove in an inner circumferential surface thereof and the oil feed pillar is press fitted therein except for the groove.

10. The compressor according to claim 8, wherein the oil feed pillar has a groove in an outer circumferential surface thereof and is press fitted into the oil feeder.

11. The compressor according to claim 1, further comprising:

a refrigerant suction passage through which the refrigerant is sucked into the compression chamber through the rotational shaft and the roller, wherein the refrigerant suction passage is formed separately from the plurality of oil feed passages.

12. The compressor according to claim 1, wherein the rotational shaft extends from one axial side of the roller, and wherein the first cover secured to the upper portion of the cylinder type rotor is a shaft cover and the second cover secured to the lower portion of the cylinder type rotor is a main cover;

the main cover joined to the cylinder type rotor and the roller in the axial direction to define the compression chamber therebetween, the shaft cover covering the rotational shaft and the main cover receiving the rotational shaft;

a mechanical seal axially joined to the shaft cover that rotatably supports the shaft cover onto the hermetic container; and a bearing axially joined to the main cover that rotatably supports the main cover, the rotational shaft, and the roller onto the hermetic container.

13. The compressor according to claim 12, wherein the plurality of oil feed passages comprises an oil feeder formed within the one end of the rotational shaft in the axial direction, and a first oil feed hole that radially passes through a portion of the rotational shaft and which is contiguous with the roller to be in communication with the oil feeder.

14. The compressor according to claim 13, wherein the plurality of oil feed passages further comprises a plurality of first oil storage cavities formed in the rotational shaft having the first oil feed hole and in one axial side of the roller, and wherein the roller is connected to the rotational shaft, so as to temporarily collect oil supplied through the first oil feed hole.

15. The compressor according to claim 14, wherein the plurality of first oil storage cavities is formed to lubricate the bearing, which is in contact with an outer circumferential surface of the rotational shaft and with the one axial side of the roller.

16. The compressor according to claim 15, wherein the plurality of oil feed passages further comprises a second oil feed hole that axially passes through the roller to be in communication with the plurality of first oil storage cavities, and a plurality of second oil storage cavities formed at the other axial side of the roller having the second oil feed hole so as to temporarily collect the oil supplied through the second feed hole.

17. The compressor according to claim 16, wherein the plurality of oil feed passages further comprises an oil feed groove provided in the roller and the vane that communicates with at least one of the plurality of first oil storage cavities via the plurality of second oil storage cavities.

18. The compressor according to claim 13, wherein the plurality of oil feed passages is mounted with an oil feed member that pumps the oil up to the oil feeder, and wherein the oil feed member is twisted in a spiral shape.

19. The compressor according: to claim 13, wherein the oil feeder comprises an oil feed pillar located within the rotational shaft, such that the oil feeder feeds the oil through the plurality of oil feed passages by a capillary phenomenon.

20. The compressor according to claim 19, wherein the oil feeder includes a groove in an inner circumferential surface thereof, and wherein the oil feed pillar is press fitted therein except for the groove.

21. The compressor according to claim 19, wherein the oil feed pillar has a groove in an outer circumferential surface and is press fitted into the oil feeder.

* * * * *